US010683141B2

(12) United States Patent
Chandaria et al.

(10) Patent No.: US 10,683,141 B2
(45) **Date of Patent: *Jun. 16, 2020**

(54) SECURE SHOPPING BAG

(71) Applicant: KITARU INNOVATIONS INC., Warrens, St. Michael (BB)

(72) Inventors: Kapoor Chandaria, Nairobi (KE); Brian Tobias, Richmond Hill (CA); J. Gordon Murphy, St. James (BB)

(73) Assignee: Kitaru Innovations, Inc., Warrens (BB)

( * ) Notice: Subject to any disclaimer, the term of this patent is extended or adjusted under 35 U.S.C. 154(b) by 616 days.

This patent is subject to a terminal disclaimer.

(21) Appl. No.: 15/368,090

(22) Filed: Dec. 2, 2016

(65) Prior Publication Data

US 2017/0166358 A1 Jun. 15, 2017

Related U.S. Application Data

(60) Provisional application No. 62/265,628, filed on Dec. 10, 2015.

(51) Int. Cl.
*B65B 7/02* (2006.01)
*B65B 61/14* (2006.01)
(Continued)

(52) U.S. Cl.
CPC ..... *B65D 33/06* (2013.01); *B65B 7/02* (2013.01); *B65B 61/14* (2013.01); *B65B 61/18* (2013.01); *B65D 31/08* (2013.01); *B65D 31/10* (2013.01); *B65D 33/004* (2013.01); *B65D 33/007* (2013.01); *B65D 33/1683* (2013.01);
(Continued)

(58) Field of Classification Search
CPC ..... B65B 7/02; B65B 61/14; B65B 61/18; B65B 61/182; B65B 5/10; B65B 5/101; B65B 5/106; B65B 7/06; B65B 25/14; B65B 35/50; B65B 43/54; B65D 33/06; G07D 11/009; G07D 11/0096;
(Continued)

(56) References Cited

U.S. PATENT DOCUMENTS 1,792,885 A * 2/1931 Andrews ..... B65D 33/243 229/84
2,050,967 A * 8/1936 Farmer ..... B65D 33/10 383/6

(Continued)

*Primary Examiner* — Praachi M Pathak
(74) *Attorney, Agent, or Firm* — Sand, Sebolt & Wernow Co., LPA

(57) ABSTRACT

A security handle for a bag that holds merchandise, a bag incorporating the handle and a method of using the same. A first handle section of the security handle is secured to a first wall of the bag. A second section of the handle is folded over an upper end of the bag and is secured to a second wall of the bag that is opposite the first wall. The handle thereby closes off access to an interior compartment defined by the bag, thereby securing merchandise within the interior compartment. The handle includes a selectively removable tamper-proof opener member positioned between the first and second handle sections. The opener member is removed after delivery of the bag to a customer to allow access to interior compartment of the bag. The opener member may be a pull tab that is integrally formed with the first and second handle sections.

18 Claims, 28 Drawing Sheets

(51) Int. Cl.

| | |
|---|---|
| ***B65B 61/18*** | (2006.01) |
| ***B65D 33/06*** | (2006.01) |
| ***B65D 33/16*** | (2006.01) |
| ***B65D 77/30*** | (2006.01) |
| ***B65D 30/18*** | (2006.01) |
| ***B65D 30/20*** | (2006.01) |
| ***B65D 33/00*** | (2006.01) |
| ***B65D 33/18*** | (2006.01) |

(52) U.S. Cl.
CPC ..... *B65D 33/1691* (2013.01); *B65D 33/18* (2013.01); *B65D 77/30* (2013.01)

(58) Field of Classification Search
CPC ..... G07D 11/12; G07D 11/125; G07D 11/16; G07D 11/40; G07D 11/50
USPC ..... 53/412, 413, 459, 75, 540, 567, 576, 53/284.7
See application file for complete search history.

(56) References Cited

U.S. PATENT DOCUMENTS 2,400,759 A * 5/1946 Katz ..... B65D 33/08 16/406
2,675,957 A * 4/1954 Zimmerman ..... B65D 33/1691 383/35
2,721,023 A * 10/1955 Phipps ..... B65D 33/1691 383/35
2,722,368 A * 11/1955 Gottsegen ..... B65D 33/10 383/6
3,240,420 A * 3/1966 Membrino ..... B65D 75/566 383/10
3,282,493 A * 11/1966 Kamins ..... B65D 33/1683 383/15
3,311,144 A * 3/1967 Lindley ..... B65D 33/1683 383/203
3,402,749 A * 9/1968 Kinzler ..... B65D 33/08 383/10
3,439,468 A * 4/1969 Bok ..... B65B 51/06 53/412
3,509,927 A * 5/1970 Ausnit ..... B65D 33/06 24/594.1
3,529,317 A * 9/1970 Schwarzkopf ..... A45C 13/26 16/407
3,567,110 A * 3/1971 Susuki ..... B65D 33/08 383/10
3,568,918 A * 3/1971 Blomqvist ..... A45C 3/04 383/109
3,727,829 A * 4/1973 Huni ..... B65D 33/1683 24/30.5 R
3,877,352 A * 4/1975 Brieske ..... B65D 33/10 383/28
4,125,220 A * 11/1978 Suominen ..... B65D 33/08 383/37
4,874,255 A * 10/1989 Ball ..... B65D 33/065 383/8
4,877,335 A * 10/1989 Barnard ..... B65D 33/065 383/6
5,108,194 A * 4/1992 Raden ..... B65D 33/1691 383/5
5,112,138 A * 5/1992 Peppiatt ..... B65D 33/10 383/203
5,121,995 A * 6/1992 Newman ..... B65D 33/06 383/207
5,158,368 A * 10/1992 Lichtwardt ..... B65D 33/08 383/10
5,165,800 A * 11/1992 Downey ..... B65D 33/1691 383/104
5,722,773 A * 3/1998 Conrad ..... B65D 33/065 383/10
5,782,562 A * 7/1998 Anspacher ..... B65D 33/08 383/15
6,176,613 B1 * 1/2001 Chen ..... B65D 33/00 206/522
7,351,458 B2 * 4/2008 Leighton ..... B65D 33/1691 428/126
7,419,300 B2 * 9/2008 Pawloski ..... B65D 33/10 383/10
7,427,161 B2 * 9/2008 Sill ..... B65D 31/10 383/127
7,530,740 B2 * 5/2009 Geyer ..... B65D 33/004 383/10
8,142,340 B2 * 3/2012 Mantzivis ..... B65D 33/10 383/10
9,011,003 B2 * 4/2015 Pawloski ..... B65D 33/2508 383/61.2
9,520,150 B2 * 12/2016 Motsch ..... B65D 75/563
10,076,169 B2 * 9/2018 Clough ..... A45C 3/10
2003/0228078 A1 * 12/2003 Clune ..... A44B 18/0084 383/93
2004/0146223 A1 * 7/2004 Marquet ..... B65D 33/008 383/6
2005/0135712 A1 * 6/2005 Barbier ..... B65D 33/25 383/78
2006/0182369 A1 * 8/2006 Schneider ..... A45C 13/1023 383/10
2017/0166357 A1 * 6/2017 Chandaria ..... B65B 7/02

* cited by examiner

SECURE SHOPPING BAG

CROSS-REFERENCE TO RELATED APPLICATIONS

This application claims the benefit of U.S. Provisional Patent Application Ser. No. 62/265,628 filed Dec. 10, 2015, the entire disclosure of which is incorporated herein by reference.

BACKGROUND OF THE INVENTION

Technical Field

This invention relates generally to shopping bags. In one aspect this invention is directed to a shopping bag that is packaged at a store or packaging facility and is then delivered to a customer located remotely from where the bag is packed. Specifically, this aspect of the present invention is a security handle that is engaged with a bag, where the security handle is an anti-tampering handle that closes the bag and secures the merchandise therein; and where the handle includes a tamper-proof closure that is removed by the customer after delivery. In another aspect, this invention is directed to a shopping bag useful for carrying loads of up to about ten kilograms or around twenty-five pounds. Specifically, this second aspect of the present invention is directed to a shopping bag made of recyclable paper products that is provided with molded plastic handles which snap into engagement with the bag and are useful for carrying the same.

Background Information

A number of businesses receive orders for merchandise online or over the phone. The business processes the orders, packages the ordered merchandise in a container and then delivers that package to the customer who is typically located remote from the packaging facility. Typically, such merchandise is packaged in cardboard boxes that are sealed after packaging and the boxes are delivered in the sealed state to the customer.

Until now it has not been possible to package merchandise ordered online or over the phone into a shopping bag and then deliver that shopping bag to a remote customer. The reason for this is that shopping bags cannot be sealed and therefore the packaged goods may be tampered with or may be stolen before the shopping bag reaches the customer. A still further issue with using shopping bags in these settings is that merchandise packaged into such bags may simply fall out of the bag while it is in transit.

In other instances, shopping bags, such as those provided by grocery stores may be made from a thin film of plastic. The plastic film provides a certain amount of strength and stretch that enables a relatively large load of groceries to be carried in the bag. Typically, this film-type of plastic bag includes a die cut hole in each side wall, thereby providing a type of "built-in" handle when the hand is inserted through both die-cut holes. Anyone who has tried to carry this type of plastic bag that is holding a load of around ten kilograms (about twenty pounds) will attest that the bags become very uncomfortable to carry as the "handle" tends to thin out and cut into the hand. In addition to this, plastic does not readily bio-degrade and is therefore not necessarily the most environmentally friendly choice when selecting a shopping bag. A second possible option when it comes to shopping bags is a plastic bag where, instead of being fabricated from a thin film, the bag is fabricated from a thicker, stronger and less flexible plastic that may be able to hold its own shape even when nothing is inside the bag. These types of thicker plastic bags may be provided with a thin strap-type of handle on each side wall or half of a molded and more rigid handle on each side wall. The two plastic straps or the halves of the molded handles are moved toward each other to form the bag's handle. The molded handle is stronger than the strap-type handle, but both of these handles are easier to hold and the bag is therefore easier to use when heavier loads are received therein. This thicker plastic shopping bag is considered to be more environmentally friendly than the thin film type bags as the thicker plastic bags may be reused several times before they start to break. The thicker plastic bags are still fabricated out of a fossil-fuel based chemical and are therefore less environmentally that is really desirable.

Reusable cloth bags with strap-type handles, also made of cloth, may be used instead of the thicker plastic bags or the thinner film-type bags. The cloth bags are strong and are capable of carrying heavier loads without breaking. This type of bag also tends to be more environmentally friendly because it is not fabricated from plastic.

Finally, shopping bags may be fabricated from paper, particularly Kraft paper. Paper bags are considered to be better for the environment because they can be fabricated from recycled paper products and are biodegradable. Paper bags may be free of handles or may be provided with a strap-type handle made from tri-folded Kraft paper, or from string (natural fibers or plastic) or ribbon. The strap-type paper handles are flat and broad and are typically glued to each side wall of the bag. These handles may have a tendency to break free from the side walls of the bag or to tear apart if a heavier load of goods, such as groceries, is carried. Other paper bags may include a pair of spaced-apart apertures defined in each side wall and have a length of string or ribbon threaded through these apertures. These lengths of string or ribbon are thinner, cylindrical members that are twine-like. The lengths of string or ribbon form the handles by which these bags may be held. While these types of handles make it possible to carry the bag, they are prone to cut into the hand and may tend to rip out of the bag if the load carried in the bag is on the heavier side.

Yet other paper bags may include die-cut holes that are spaced a short distance inwardly from an upper edge of each of the bag's side walls. The portion of the side wall between the top of the die-cut hole and the upper edge forms a portion of a handle for carrying the bag. In some instances a plastic insert may be provided on the side wall which circumscribes the die-cut hole. The plastic inserts are glued to the side wall and reinforce the handle. While these plastic inserts make it easier to carry the bag they also complicate the recycling of the bag because of the addition of a second material that is reasonably difficult to separate from the paper used to fabricate the bag.

SUMMARY

Because of the aforementioned issues with shopping bags, the solution up to this point has been to package all such merchandise in cardboard boxes as indicated above. The present inventors have, however, contemplated a different solution, namely, providing a method of retaining a shopping bag in a closed position after it has been packaged using a handle. Not only does the handle close off access to an interior compartment within the bag, the handle also provides a way for a customer to be assured that all of the ordered merchandise is retained in the bag in an untampered state. The presently disclosed shopping bag, security handle and method of use is contemplated for use for a wide range of products, one of them being delivering groceries that are ordered online. The shopping bag may be fabricated from a material that has sufficient strength to hold around twenty-five pounds of merchandise in its interior. Additionally, the shopping bag material may be moisture resistant and suitable to be cooled or even frozen. All materials utilized in the bag and in the handle, including any adhesives used therein, may therefore be selected because they can withstand moist and cold conditions. Additionally, all materials utilized in producing the bag and handle, including any adhesives used therein, may also be selected based on being safe for use around food products.

In one aspect, the invention may provide a security handle for a bag that holds merchandise, said handle being engageable with an upper end of the bag and sealing off access to an interior compartment defined by the bag; and wherein the handle includes an opener member that is tamper-proof and is selectively openable after delivery of the bag to a customer to allow access to the interior compartment.

In another aspect, the invention may provide a security handle for use with a bag, where the bag has a front wall with a top edge region and a back wall with a top edge region; said handle comprising a planar sheet of material having a top surface and a bottom surface; a frangible zone dividing the planar sheet of material into a first handle section and a second handle section; wherein the first handle section is engageable with the front wall and the second handle section is engageable with the back wall, and wherein a region of the planar sheet of material including the frangible zone closes off access to an opening defined between the top edge regions of the front wall and the back wall; and wherein the frangible zone is selectively tearable to permit access to the opening.

In another aspect, the invention may provide a security handle for use with a bag having a front wall with a top edge region and a back wall with a top edge region; said handle comprising a first handle section and a second handle section each of which has a top surface and a bottom surface; a removable opener member positioned between the first handle section and the second handle section; a first aperture defined in the first handle section and extending between the top and bottom surface thereof; a first adhesive region applied to the top surface of the first handle section between the first aperture and the opener member; a second aperture defined in the second handle section and extending between the top and bottom surfaces thereof; a second adhesive region applied on the top surface of the second handle section between the second aperture and the opener member; a third adhesive region applied on the bottom surface of the first handle section between the first aperture and the opener member; and a fourth adhesive region applied on the bottom surface of the second handle section between the second aperture and the opener member; and wherein the third adhesive region is adapted to adhere to the top edge region of the front wall of the bag and the fourth adhesive region is adapted to adhere to the top edge region of the back wall; and the bag is retained in a closed position by the handle until the opener member is removed.

In yet another aspect, the invention may provide in combination a bag having a front wall having a top edge region; a back wall having a top edge region; a first side and a second side that extend between the front wall and back wall; and a security handle comprising a planar sheet of material having a top surface and a bottom surface; a frangible zone dividing the planar sheet of material into a first handle section and a second handle section; a first aperture defined in the first handle section and extending between the top and bottom surfaces; a first adhesive region applied between the first aperture and the frangible zone; a second aperture defined in the second handle section and extending between the top and bottom surfaces; a second adhesive region applied between the second aperture and the frangible zone; wherein the first adhesive region adheres to the top edge region of the front wall of the bag and the second adhesive region adheres to the top edge region of the back wall; and when the first and second adhesive regions are engaged with the bag's front wall and back wall, respectively, the handle closes off access to an interior compartment defined by the bag until the frangible zone is broken open.

In another aspect, the invention may provide in combination a bag having a back wall, a front wall having an top edge region; a back wall having an top edge region; and a first side and a second side that extend between the front and back walls; and a security handle engageable with the top edge regions of the front and back walls of the bag; said security handle sealing off access to an interior compartment defined by the bag; and wherein the security handle includes an opener member that is tamper-proof and is selectively openable to allow access to the interior compartment.

In another aspect, the invention may provide a method of securely carrying merchandise inside a bag, where the bag has a front wall having a top edge region; a back wall having a top edge region; and a first side and a second side that extend between the front wall and the back wall; said method comprising: placing merchandise within an interior compartment defined by the bag; providing a handle comprising a first handle section and a second handle section with a frangible zone defined between the first and second handle sections; engaging the first handle section on the front wall of the bag adjacent the top edge region thereof; positioning the frangible zone of the handle across an opening defined between the top edge region of the front wall and the top edge region of the back wall; engaging the second handle section on the back wall of the bag adjacent the top edge region thereof; blocking the opening with the frangible zone; and retaining the merchandise in the interior compartment.

There is furthermore a need in the art for a paper shopping bag that is easier to carry because it includes a handle but where that handle is readily separable from the bag and is therefore relatively environmentally friendly. In one aspect the invention may provide a bag for carrying goods comprising a paper bag having a front wall with an upper end; a back wall with an upper end; a bottom wall and opposed side walls extending between the front wall and back wall; and a compartment defined by the front wall, back wall, bottom wall and side walls; a first handle section engaged with the front wall proximate the upper end thereof; and a second handle section engaged with the back wall proximate the upper end thereof; wherein each of the first and second handle sections is fabricated from plastic.

In another aspect, the invention may provide a method of fabricating a bag for carrying goods, comprising providing a bag made from a paper-based product; where the bag includes a front wall with an upper end; a back wall with an upper end; a bottom wall and opposed side walls extending between the front wall and back wall; and a compartment defined by the front wall, back wall, bottom wall and side walls; providing a plastic handle assembly comprising a first handle section and a second handle section; each of the first and second handle sections including a first handle member and a second handle member; positioning the first handle member of the first handle section against an exterior surface of the front wall and positioning the second handle member of the first handle section against an interior surface of the front wall; securing the first handle member and second handle member of the first handle section together; capturing a section of the front wall between the secured first and second handle members; positioning the first handle member of the second handle section against an exterior surface of the back wall and positioning the second handle member of the second handle section against an interior surface of the back wall; securing the first handle member and second handle member of the second handle section together; and capturing a section of the back wall between the secured first and second handle members of the second handle section.

BRIEF DESCRIPTION OF THE SEVERAL VIEWS OF THE DRAWINGS

A sample embodiment of the invention is set forth in the following description, is shown in the drawings and is particularly and distinctly pointed out and set forth in the appended claims.

Similar numbers refer to similar parts throughout the drawings.

DETAILED DESCRIPTION

Figure 17:
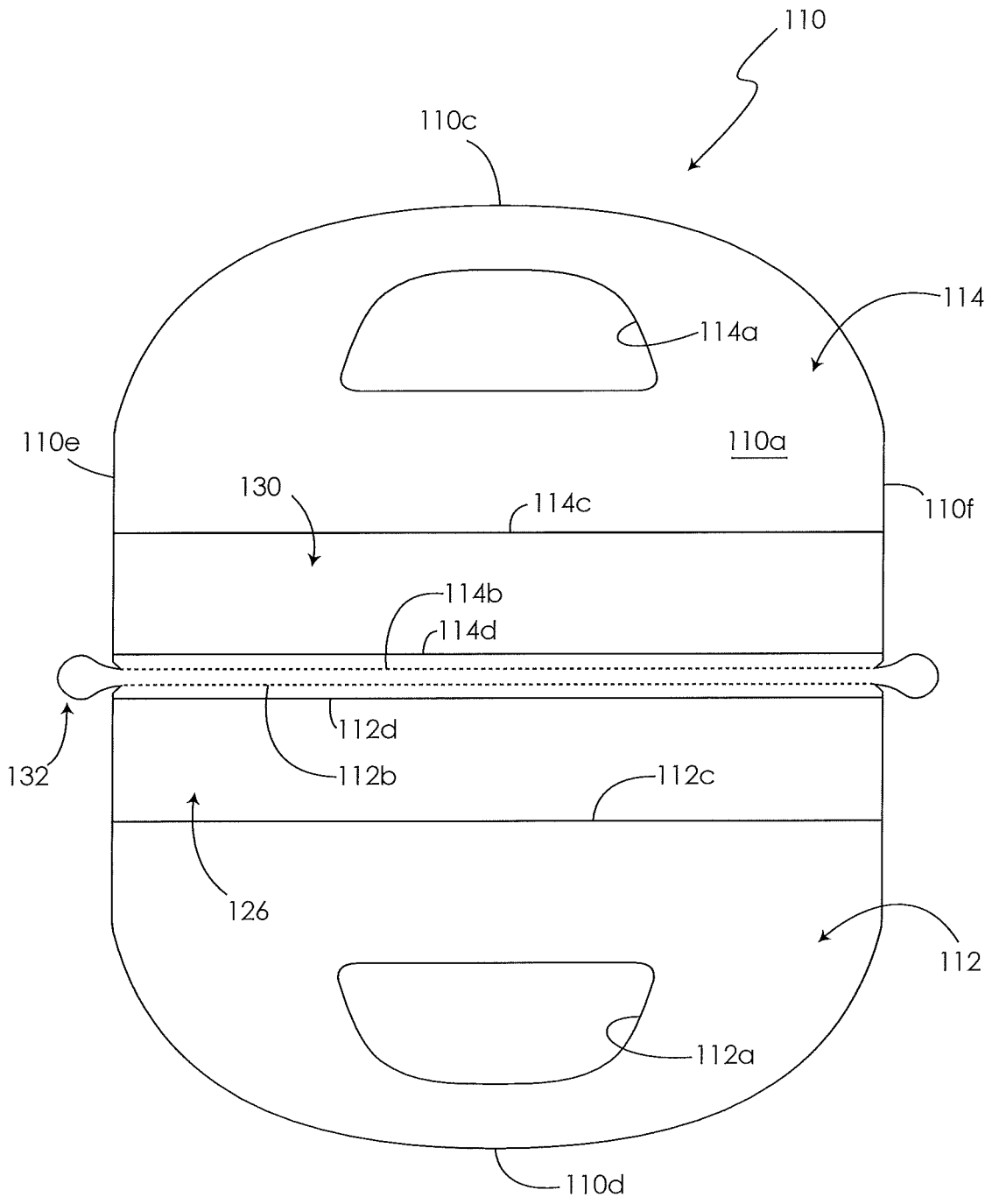
FIG. 17 is a top plan view of a second embodiment of the security handle that includes adhesive regions on only the back wall of the planar sheet, and wherein the adhesive regions on the front wall of the planar sheet are omitted.
Figure 18:
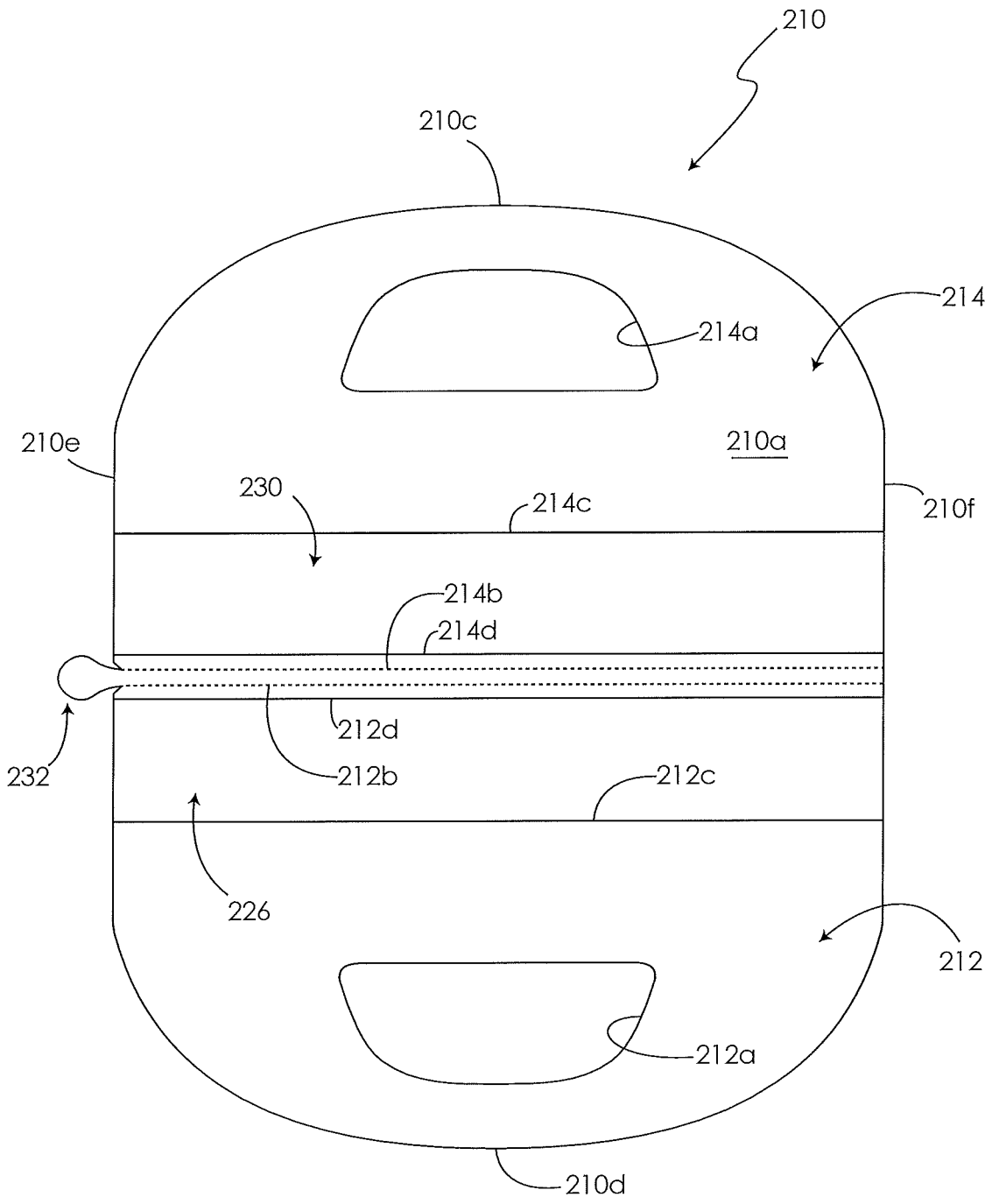
FIG. 18 is a top plan view of a third embodiment of the security handle showing a differently configured pull-tab from the pull tab shown in the preceding figures.

Referring to FIGS. 1-16, there is shown a first embodiment of a security handle for a shopping bag, a shopping bag including the security handle, and a method of fabricating the security handle. The security handle is generally indicated by the reference number 10 in these figures. FIG. 17 shows a second embodiment of the security handle, generally indicated at 110; and FIG. 18 shows a third embodiment of the security handle generally indicated at 210. FIGS. 19-24 show a method of fabricating the security handles 10, 110, and 210.

Figure 1:
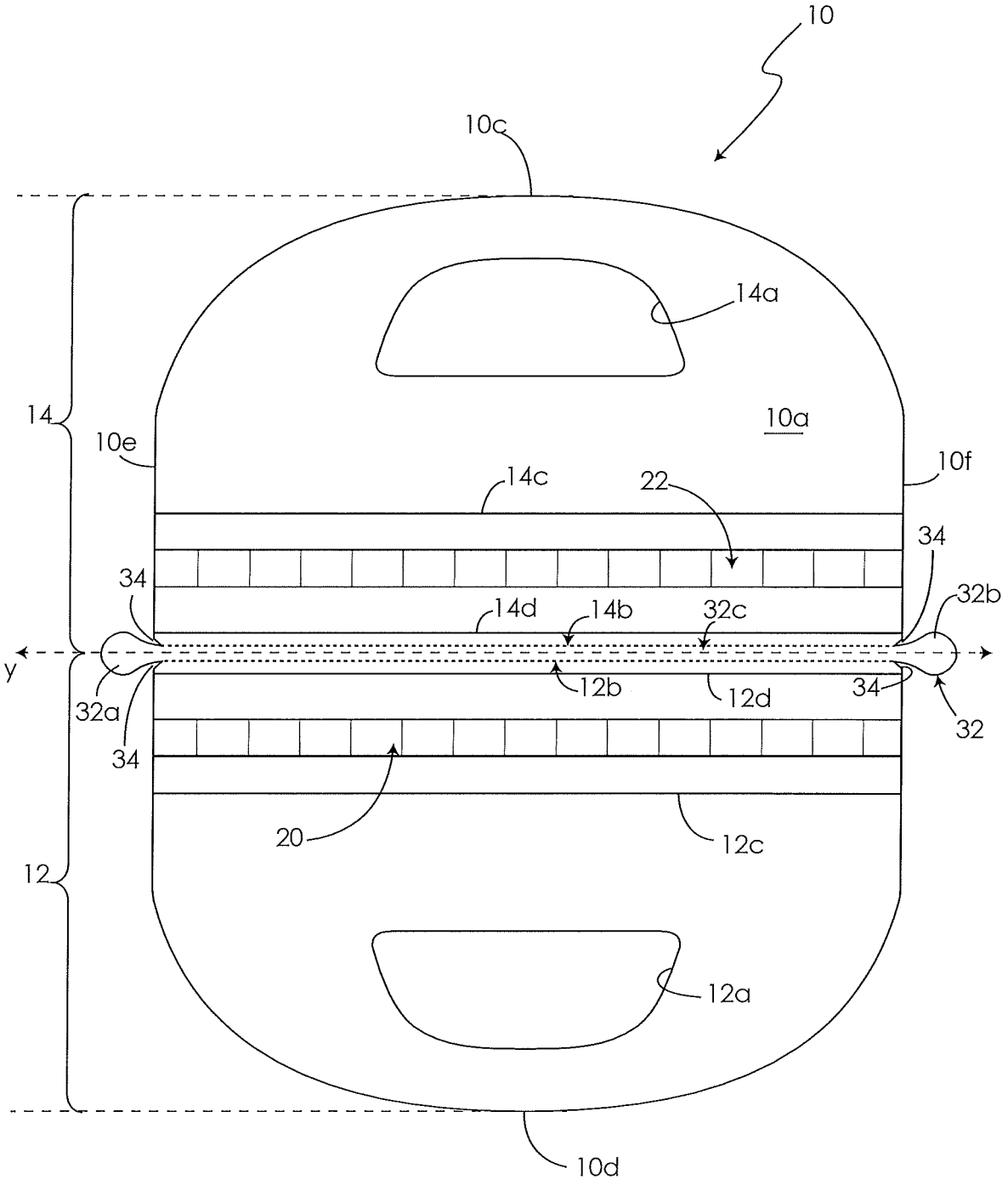
FIG. 1 is a top plan view of a first embodiment of a security handle in accordance with an aspect of the present invention.
Figure 2:
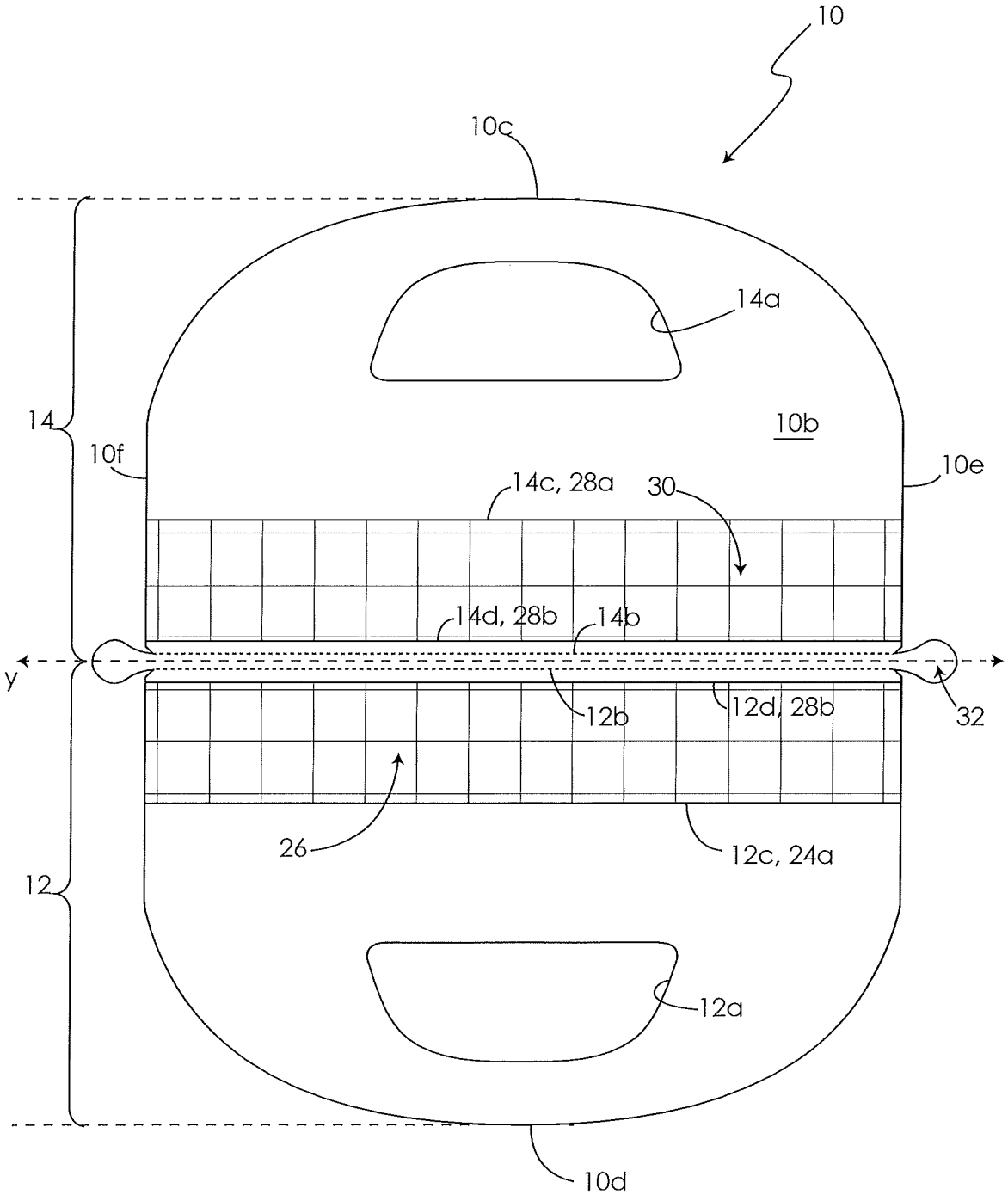
FIG. 2 is a bottom plan view of the security handle of FIG. 1.
Figure 3:
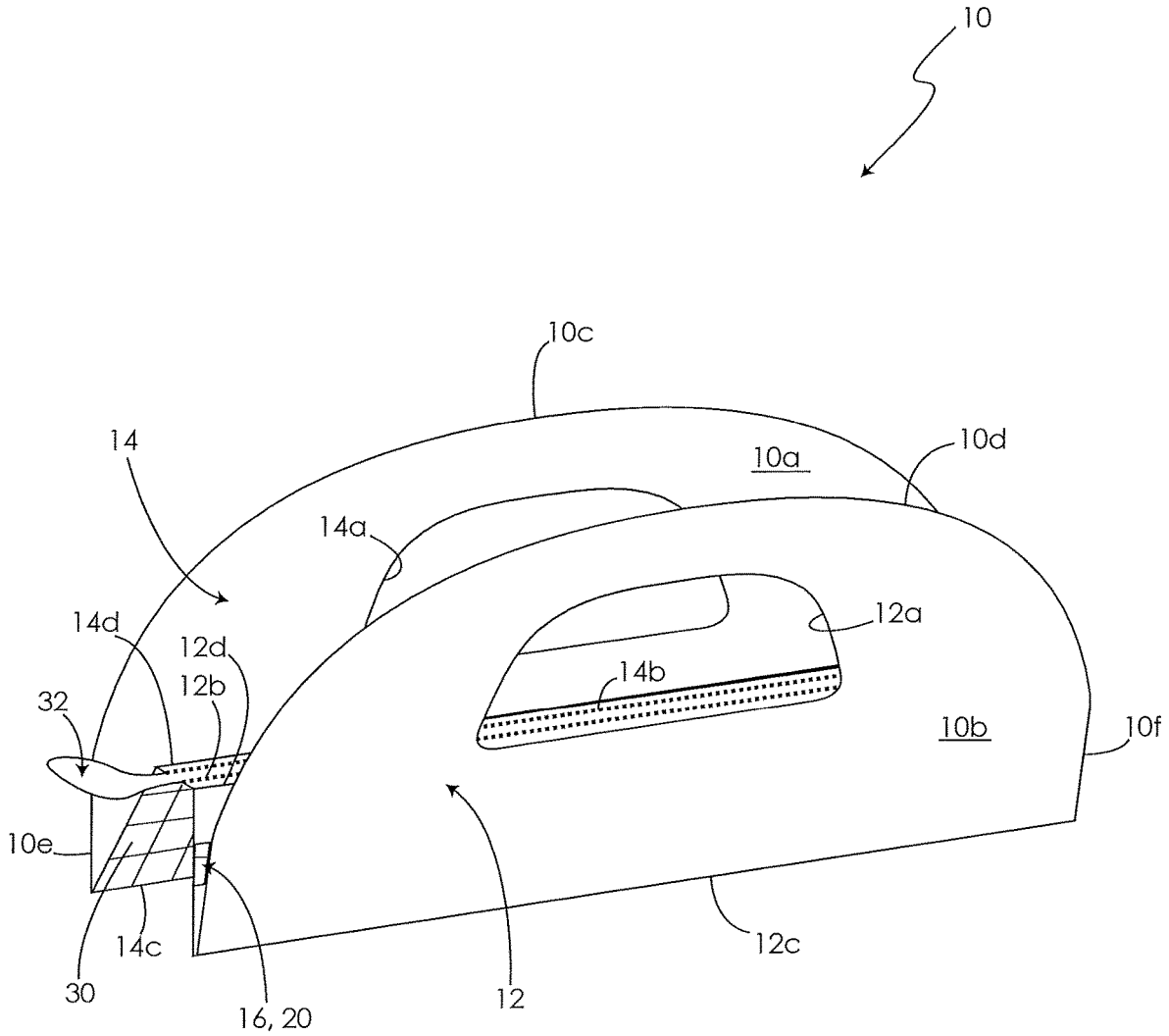
FIG. 3 is a perspective view of the security handle folded into a generally "W"-shaped configuration that the handle will assume when engaged with an upper end of a shopping bag.
Figure 4:
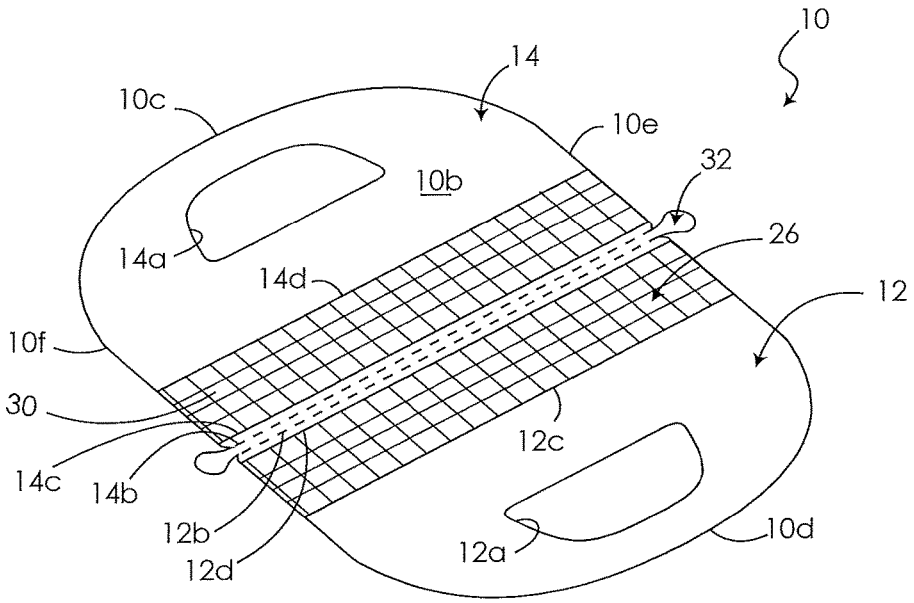
FIG. 4 is a back perspective view of the security handle showing the planar sheet of material that forms the handle blank in an unfolded, initial position.

FIGS. 1-3 show security handle 10 in greater detail. Handle 10 may be fabricated as a handle blank that may be die-cut from a planar sheet of a suitable material. A polymer/polymer blend may comprise one such suitable material used for the planar sheet of material. The term "handle blank", "handle" and "security handle" used herein should be understood to refer to the component 10 that is fabricated from the planar sheet of material and is subsequently folded and secured to the bag.

Handle 10 includes a top surface 10*a*, a bottom surface 10*b* (FIG. 2), a first end 10*c*, a second end 10*d*, a first edge 10*e*, and a second edge 10*f*. First end 10*c* and second end 10*d* may be gently curved in a complementary manner so that they may be comfortable for a user to grasp when carrying a bag that includes handle 10. Handle 10 may be fabricated in any desired shape or size and may include apertures of any desired shape or size and through which a user may insert their fingers in order to carry the bag by the handle 10. One suitable size for handle 10 is a height from top to back (when installed on the bag) of about two to three inches and a width from side to side of about twelve inches. Handle 10 preferably would be able to be reused at least twelve times and be capable of being used on a bag that weighs around twenty-five pounds. Handle 10 may be fabricated from any suitable and desired material including but not being limited to low density polyethylene (LPDE) or high density polyethylene (HPDE) and could be made with any thin film with a suitable tensile strength.

Handle 10 defines a midline "Y" (FIG. 1) that separates handle 10 into a first handle section 12 and a second handle section 14. First and second handle sections 12, 14 are mirror images of each other. First handle section 12 defines a first aperture 12*a* therein that is located a distance inwardly from second end 10*d* and is generally equidistant between first edge 10*e* and second edge 10*f*. First aperture 12*a* extends from top surface 10*a* through to bottom surface 10*b*. A first line of weakness 12*b* is defined a distance inwardly from an inner end of first aperture 12*a*. First line of weakness 12*b* extends from first edge 10*e* to second edge 10*f*. First handle section 12 also defines a first fold line 12*c* and a second fold line 12*d* that extend from first edge 10*e* to second edge 10*f*. First handle section 12 is foldable about first and second fold lines 12*c*, 12*d*, as will be later described herein. First fold line 12*c* is located a distance inwardly from the inner end of first aperture 12*a* and a distance outwardly from first line of weakness 12*b*. Second fold line 12*d* is located a small distance away from first line of weakness 12*b*.

Second handle section 14 defines a second aperture 14*a* therein that is located a distance inwardly from first end 10*c* and is generally equidistant between first edge 10*e* and second edge 10*f*. Second aperture 14*a* extends from top surface 10*a* through to bottom surface 10*b*. A second line of weakness 14*b* is defined a distance inwardly from an inner end of second aperture 14*a*. Second line of weakness 14*b* extends from first edge 10*e* to second edge 10*f*. Second handle section 14 defines a first fold line 14*c* and a second fold line 14*d* that extend from first edge 10*e* to second edge 10*f*. First fold line 14*c* is located a distance inwardly from aperture 14*a* and a distance outwardly from second line of weakness 14*b*. Second fold line 14*d* is located a small distance away from second line of weakness 14*b*. Second handle section 14 is foldable about first and second fold lines 14*c*, 14*d*, as will be later described herein.

Figure 1A:
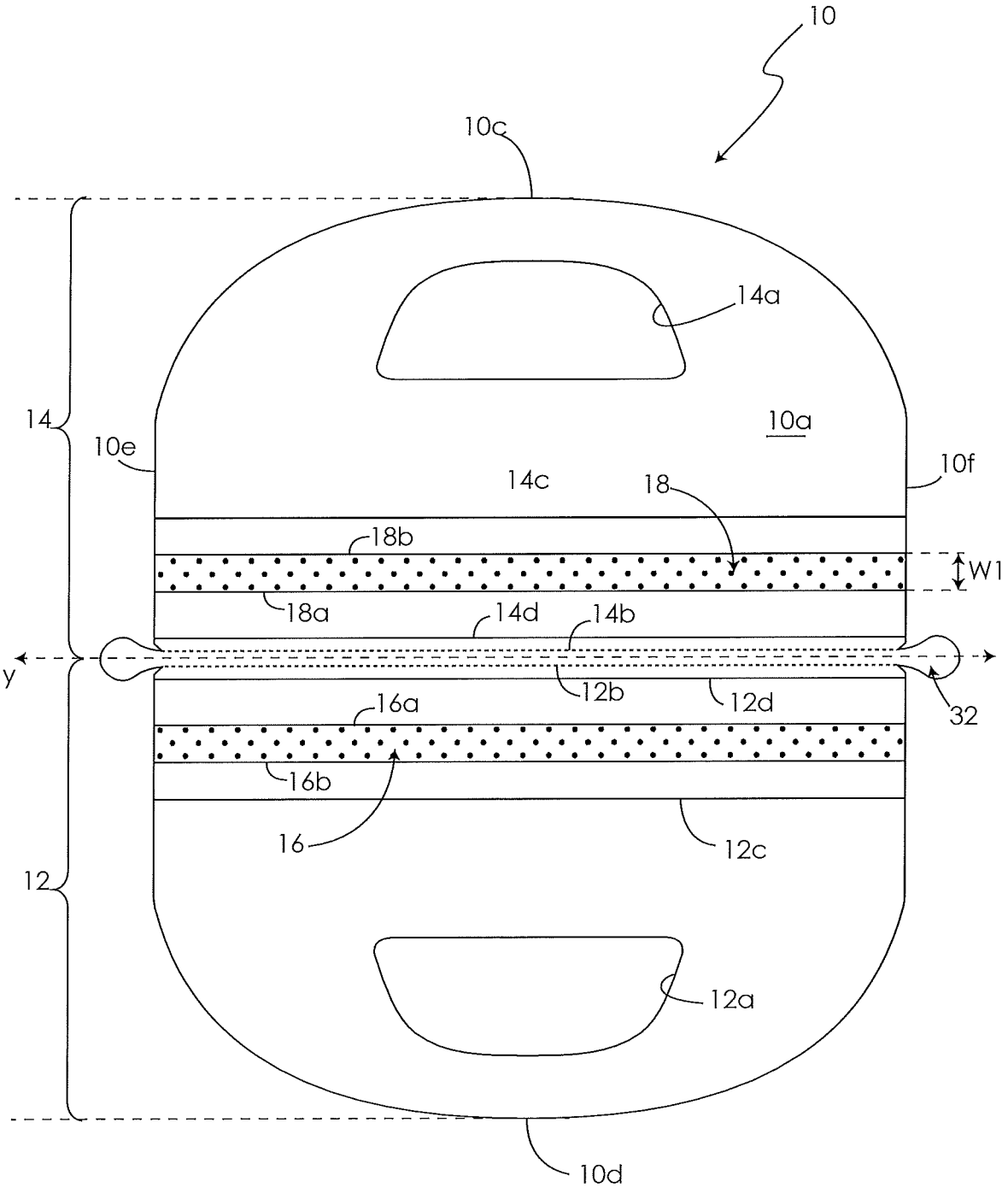
FIG. 1A is a top plan view of the security handle with protective liners removed from a first adhesive region and a second adhesive region.

FIG. 1A shows that a first adhesive region 16 and a second adhesive region are provided on top surface 10*a* of security handle 10. More specifically, first adhesive region 16 is provided on first handle section 12 of security handle 10. First adhesive region 16 extends from proximate first edge 10*e* to proximate second edge 10*f* and comprises a band of adhesive applied to top surface 10*a*. First adhesive region 16 is of a width "W1" where the width is measured from a first edge 16*a* to a second edge 16*b* of first adhesive region 16. Any suitable adhesive may be utilized in handle 10. One suitable type of adhesive for use in first and second adhesive regions 16, 18 and other adhesive regions of handle 10 includes but is not limited to a rubber-based freezer grade adhesive that may be applied using hot-melt rubber.

FIG. 1A also shows that second adhesive region 18 is provided on second handle section 14 of security handle 10. Second adhesive region 18 extends from proximate first edge 10*e* to proximate second edge 10*f* and comprises a band of adhesive applied to top surface 10*a*. Second adhesive region 18 is of the same width as first adhesive region 16, i.e., width "W1" (FIG. 1A) where the width is measured from a first edge 18*a* to a second edge 18*b*. FIG. 1 shows that a first protective liner 20 is applied over first adhesive region 16 and a second protective liner 22 is applied over second adhesive region 18. Each of the first and second protective liners 20, 22 is of substantially the same width "W1" as each of the first and second adhesive regions 16, 18.

Figure 2A:
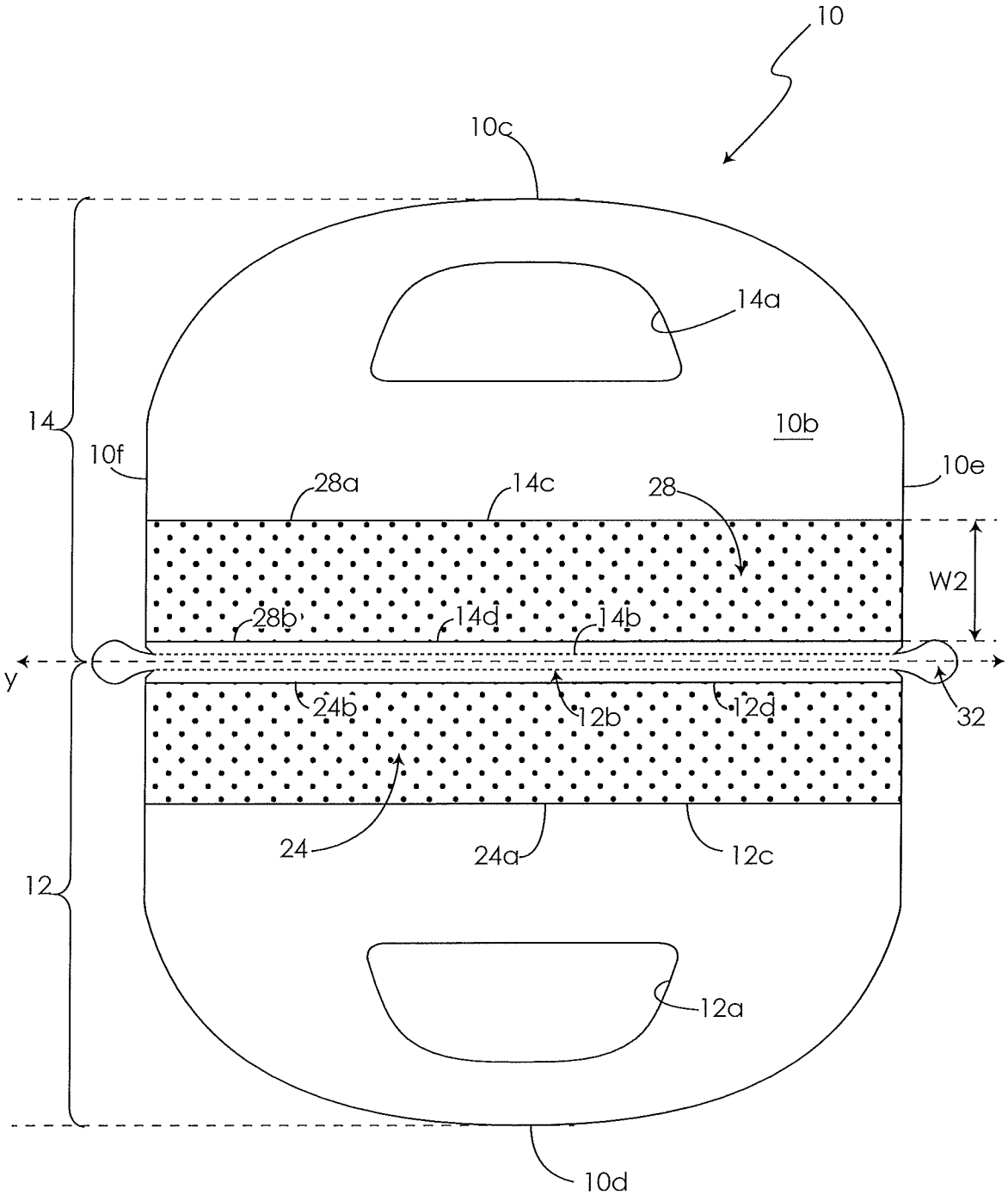
FIG. 2A is a bottom plan view of the security handle with protective liners removed from a third adhesive region and a fourth adhesive region.

FIGS. 2 and 2A show bottom surface 10*b* of security handle 10. A third adhesive region 24 (FIG. 2A) is provided on first handle section 12. Third adhesive region 24 extends from first edge 10*e* to second edge 10*f* and has a first edge 24*a* and a second edge 24*b*. First edge 24*a* is generally aligned with first fold line 12*c* and second edge 24*b* is generally aligned with second fold line 12*d*. Since first adhesive region 16 is located between first and second fold lines 12*c*, 12*d*, at least a portion of third adhesive region 24 is aligned with first adhesive region 16. Third adhesive region 24 is of a width "W2" defined between first and second edges 24*a*, 24*b*. A third protective liner 26 (FIG. 2)

is applied over third adhesive region 24 and is removed only when it is desired to use third adhesive region 24 as will be described later herein.

FIG. 2A shows a fourth adhesive region 28 is provided on second handle section 14. Fourth adhesive region 28 extends from first edge 10*e* to second edge 10*f*. Fourth adhesive region 28 has a first edge 28*a* and a second edge 28*b* and is of the same width "W2" as third adhesive region 24, where the width "W2" is measured from first edge 28*a* to second edge 28*b*. A fourth protective liner 30 (FIG. 2) is applied over fourth adhesive region 28 and is removed only when it is desired to use fourth adhesive region 28 as will be described later herein.

Handle 10 is provided with a tamper-proof opener member 32 that is selectively removal from handle 10. This opener member 32 is provided generally midway between first end 10*c* and second end 10*d* of the planar sheet that forms handle 10. The opener member 32 extends from first edge 10*e* to second edge 10*f* and is located between first handle section 12 and second handle section 14. Opener member 32 may be integral with first and second handle sections 12, 14, being formed as part of the planar sheet. The planar sheet of material that forms first handle section 12, the opener member, and second handle section 14 may be die-cut from a suitable material such as a plastic. Opener member 32 may take any suitable form but one suitable configuration of opener member is the provision of a frangible zone comprised of one or more lines of weakness (i.e., a series of perforations oriented in one or more lines) that extend from first edge 10*e* to second edge 10*f*. As illustrated in the attached figures, the frangible zone that comprises opener member 32 on handle is comprised of first and second lines of weakness 12*b*, 14*b* that are spaced a distance apart from each other such and a strip of material that lies between first and second lines of weakness 12*b*, 14*b*. The strip of material has pull tabs 32*a*, 32*b* formed at either end. The pull tabs 32*a*, 32*b* may project outwardly for a distance beyond the associated side wall of the bag so that a customer may grasp one of the tabs and tear the strip 32*c* free along the lines of weakness 12*b*, 14. This will be described in detail later herein. When this opener member 32 or frangible zone is broken, opened or removed from handle, the first and second handle sections 12, 14 will be separated from each other and a gap will open up between them. The front and rear walls 36*d*, 36*e* of bag 36 can then be moved apart from each other and interior compartment 36*f* can then be accessed to remove merchandise 44 from within compartment 44.

Opener member 32 is thus a tamper-proof opener that is provided on handle 10 in the form of pull-tab 32. It will be understood that other suitable and differently configured tamper-proof openers may be utilized on handle 10 instead of pull-tab 32. As shown in FIG. 1, pull-tab 32 includes a first tab 32*a* that extends outwardly from first edge 10*e*, a second tab 32*b* that extends outwardly from second edge 10*f*, and a pull-strip 32*c* that extends between first and second tabs 32*a*, 32*b*. Each of the first and second tabs 32*a*, 32*b* is a ovoid member that is of a width that is slightly greater than the width of pull-strip 32*c*. The ovoid tabs 32*a*, 32*b* are also of a size that is suitable to be readily and easily grasped by a user if they wish to remove pull-tab 32 from handle 10. A notched region 34 is defined between each side of first tab 32*a* and first edge 10*e* and between each side of second tab 32*b* and second edge 10*f*. Notched regions 34 angle inwardly toward the beginning of the associated first or second line of weakness 12*b*, 14*b*. First line of weakness 12*b* runs along a first edge of pull-strip 32*c* and second line of weakness 14*b* runs along a second edge of pull-strip 32*c*. If one or the other of tabs 32*a* or 32*b* is grasped and pulled toward the other of the tabs 32*a* or 32*b*, the first handle section 12 of handle 10 will become separated from the second handle section 14 thereof.

Figure 5:
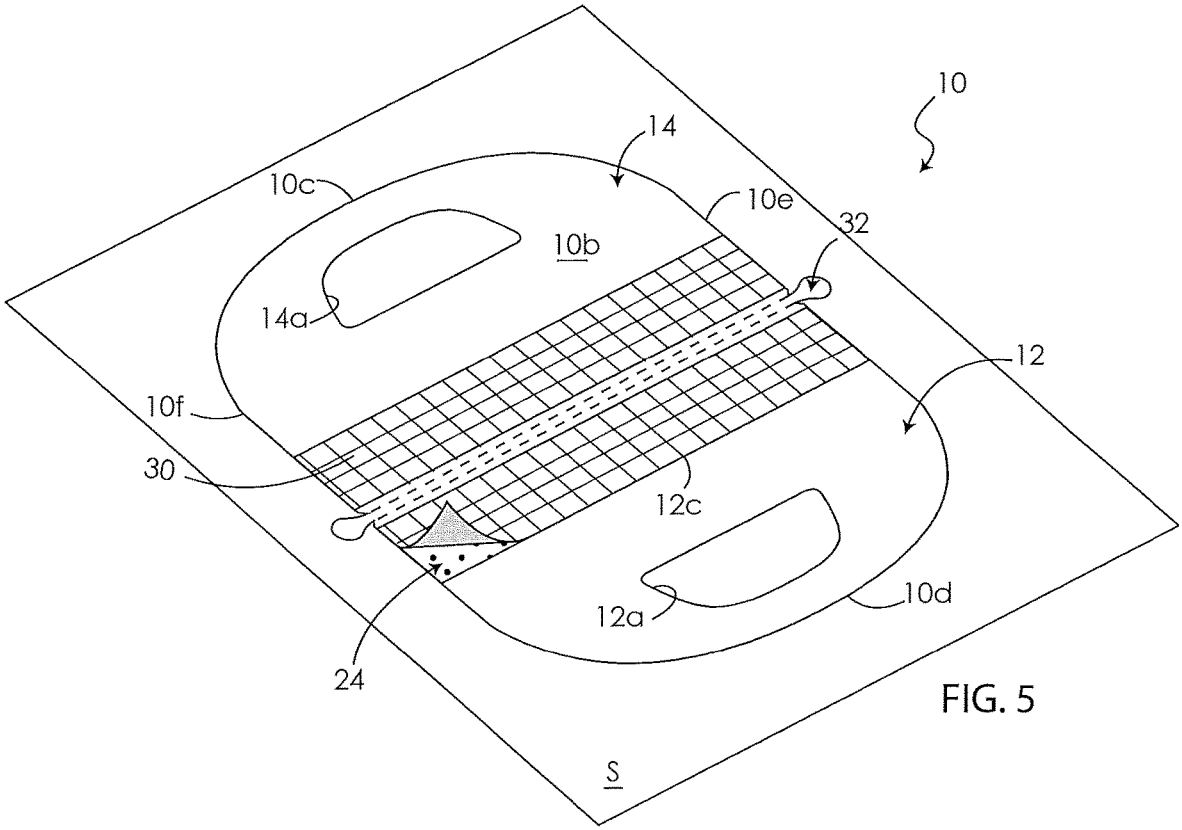
FIG. 5 is a back perspective view of the security handle showing a protective liner being removed from an adhesive region on a first handle section, while another protective liner remains in place covering another adhesive region on a second handle section.
Figure 6:
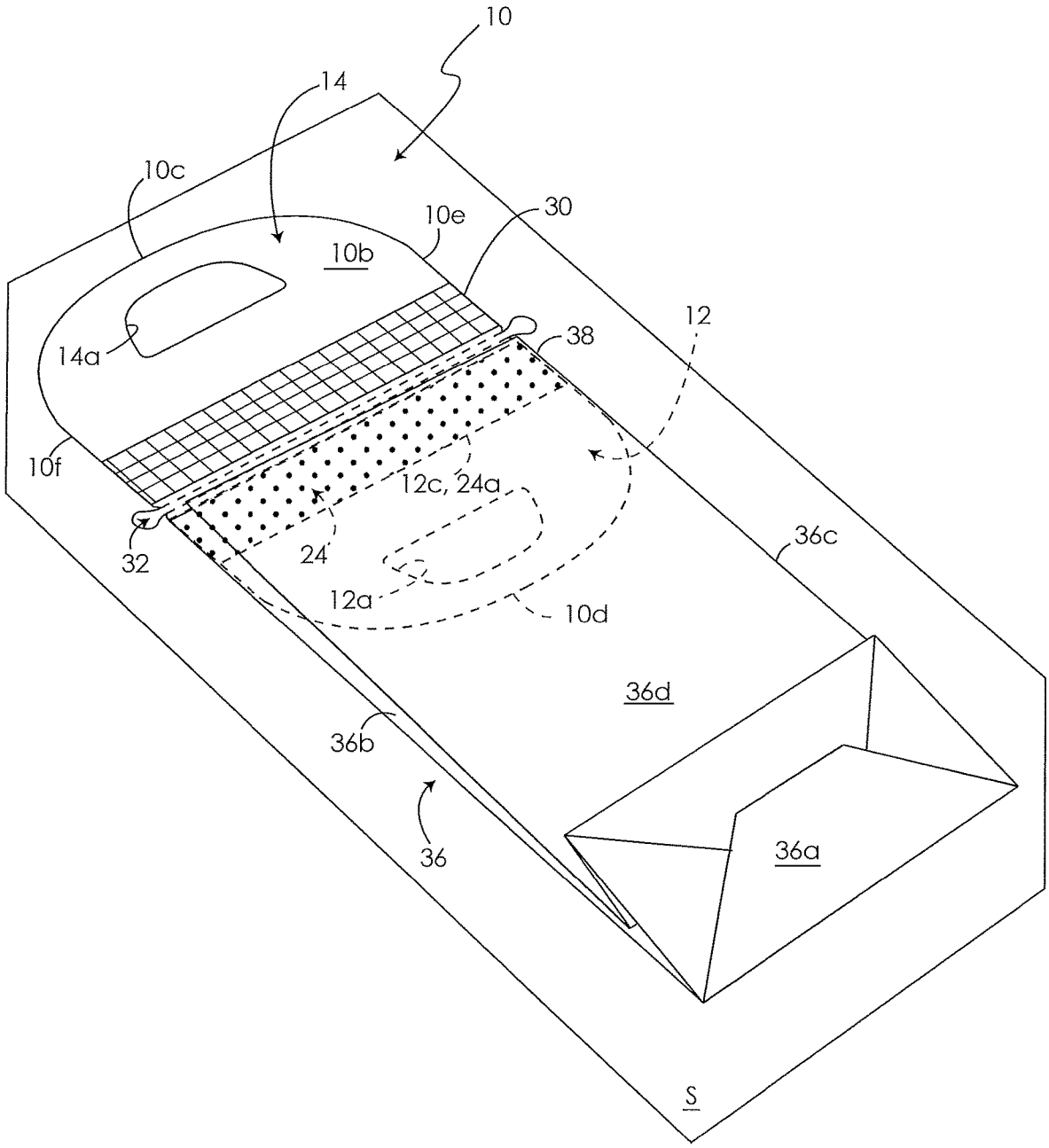
FIG. 6 is a back perspective view of the security handle where the protective liner has been completely removed from the first handle section and a shopping bag has been placed on top of the adhesive region.
Figure 7:
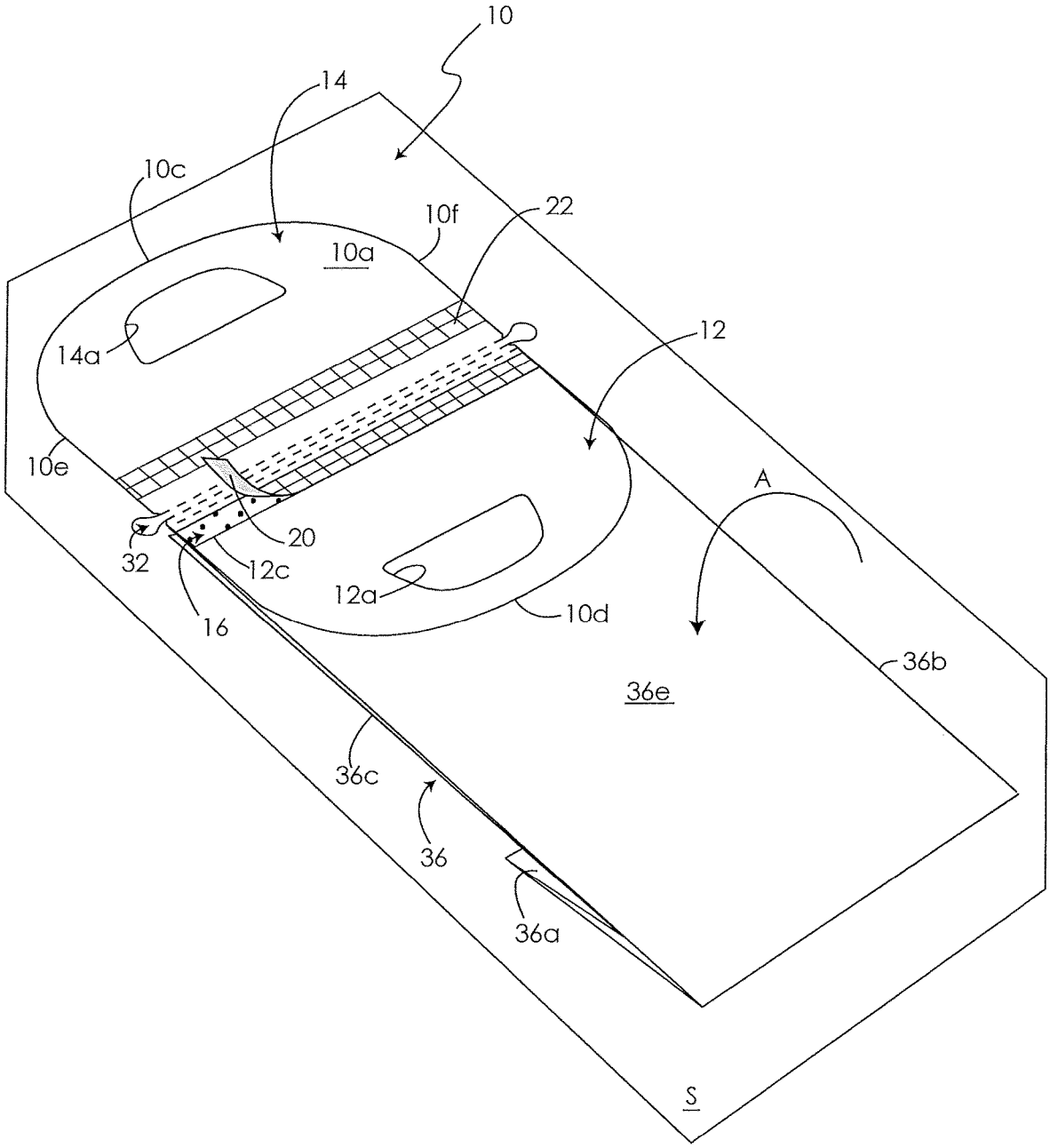
FIG. 7 is a top perspective view of the security handle engaged with the shopping bag and showing an additional protective liner being removed from another adhesive region on a top surface of the planar sheet.
Figure 8:
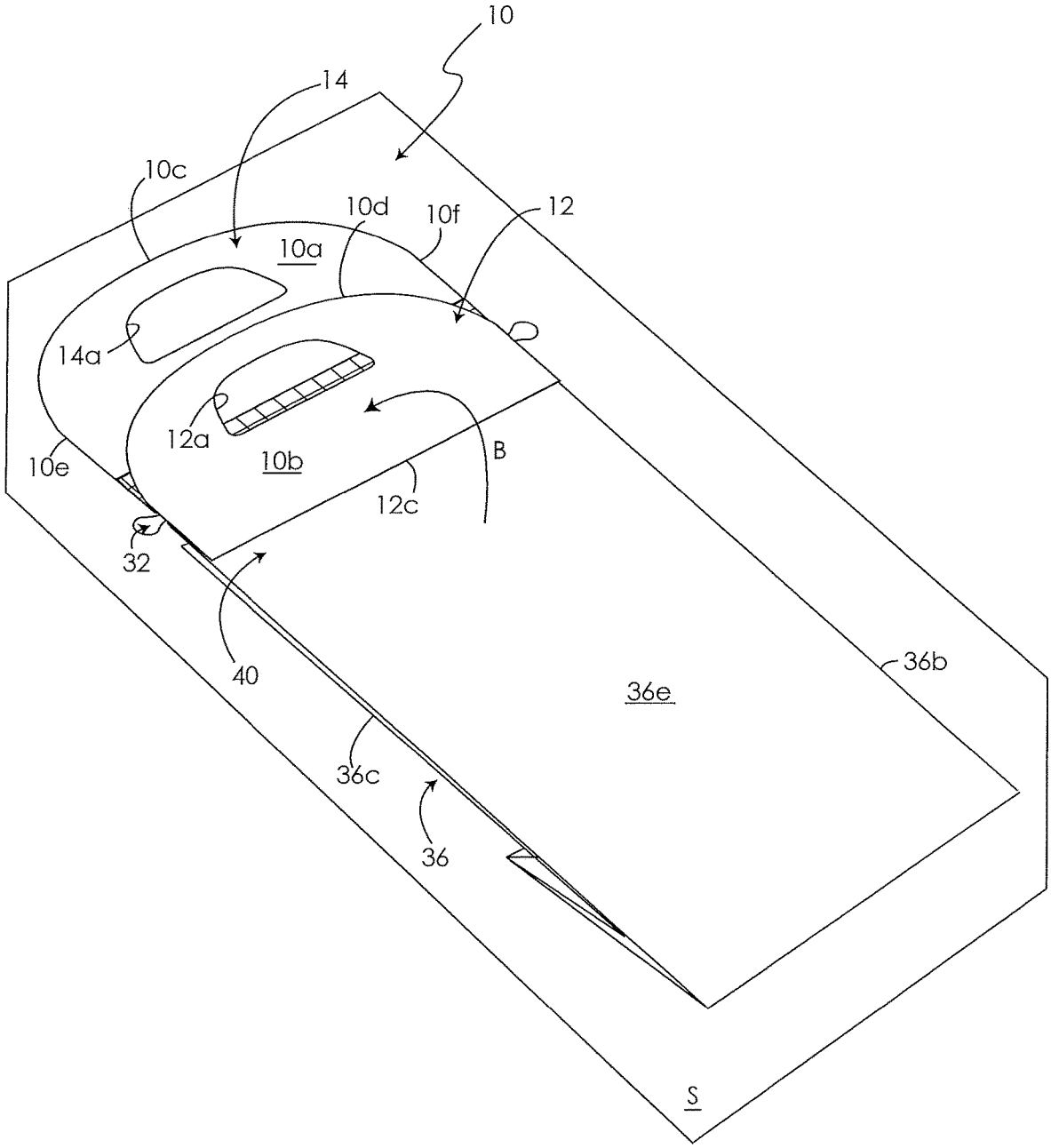
FIG. 8 is a top perspective view of the security handle showing a portion of the first handle section being folded upwardly and into engagement with a remaining part of the first handle section.

Referring to FIGS. 5-16, handle 10 is engaged with a bag 36 that has a back wall 36*a*, a first handle section wall 36*b*, a second handle section wall 36*c*, a front wall 36*d* and a back wall 36*e* (FIG. 7). Front wall 36*d* has a top edge region indicated by the reference number 38 (FIGS. 6 & 9) and back wall 36*e* has a top edge region indicated by the reference number 40 (FIG. 8). Bags 36 may be of any suitable and desired size but one particularly suitable size bag is one that is about twelve inches wide, about sixteen inches high, and has a gusset (i.e., first and second handle sections walls 36*b*, 36*d*) that is about seven inches wide.

Bag 36 may be of any suitable type and be useful for any desired purpose. A first suitable version of bag 36 may be a bag for everyday merchandise that is glued with a freezer-grade adhesive and may have a six-color print with an aqueous coating (AQ coating) on an exterior surface. A second suitable version of bag 36 is one that could be used as a "same-day grocery bag". This second version is substantially identical to the first version but is fabricated from paper coated both sides with Michelman® food-grade moisture coating. The bags 30 may be packed out at about 150 odd units per box but the final master carton when handle 10 are installed on bags 36 preferably should not exceed forty pounds in weight. Bags 36 may be packed in bundles of twenty-five in a plastic-poly bag folded over with a tape closure.

FIGS. 5 & 6 shows that handle 10 is laid flat onto a support surface "S" in such a way that top surface 10*a* of handle 10 is in abutting contact with surface "S". Third protective liner 26 is then pulled upwardly and removed from third adhesive region 24 such that the third adhesive region 24 is exposed. FIG. 6 shows bag 36 placed on top of bottom surface 10*b* of handle 10 in such a manner that top region 40 of back wall 36*e* of bag 36 covers third adhesive region 24. Preferably, the uppermost edge of top region 40 is aligned along second fold line 12*d*. Top region 40 is pressed downwardly into contact with third adhesive region 24 so that the regions 40 and 24 become adhesively bonded together.

FIG. 7 shows bag 36 and handle 10 being rotated through 180° as indicated by arrow "A" so that bottom surface 10*b* of handle 10 and front wall 36*d* of bag 36 are placed in contact with surface "S". First protective liner 20 is then pulled back and removed from first adhesive region 16. First adhesive region 16 is then exposed. FIG. 8 shows a portion of first handle section 12 of handle 10 being rotated upwardly in the direction of arrow "B" by folding the portion of first handle section 12 back onto a remaining part of first handle section along first fold line 12*c*. The folded portion of first handle section 12 is then pushed downwardly toward surface "S" and against the remaining part of first handle section 12. This motion causes the folded portion of first handle section 12 to become adhesively bonded to first adhesive region 16.

Figure 9:
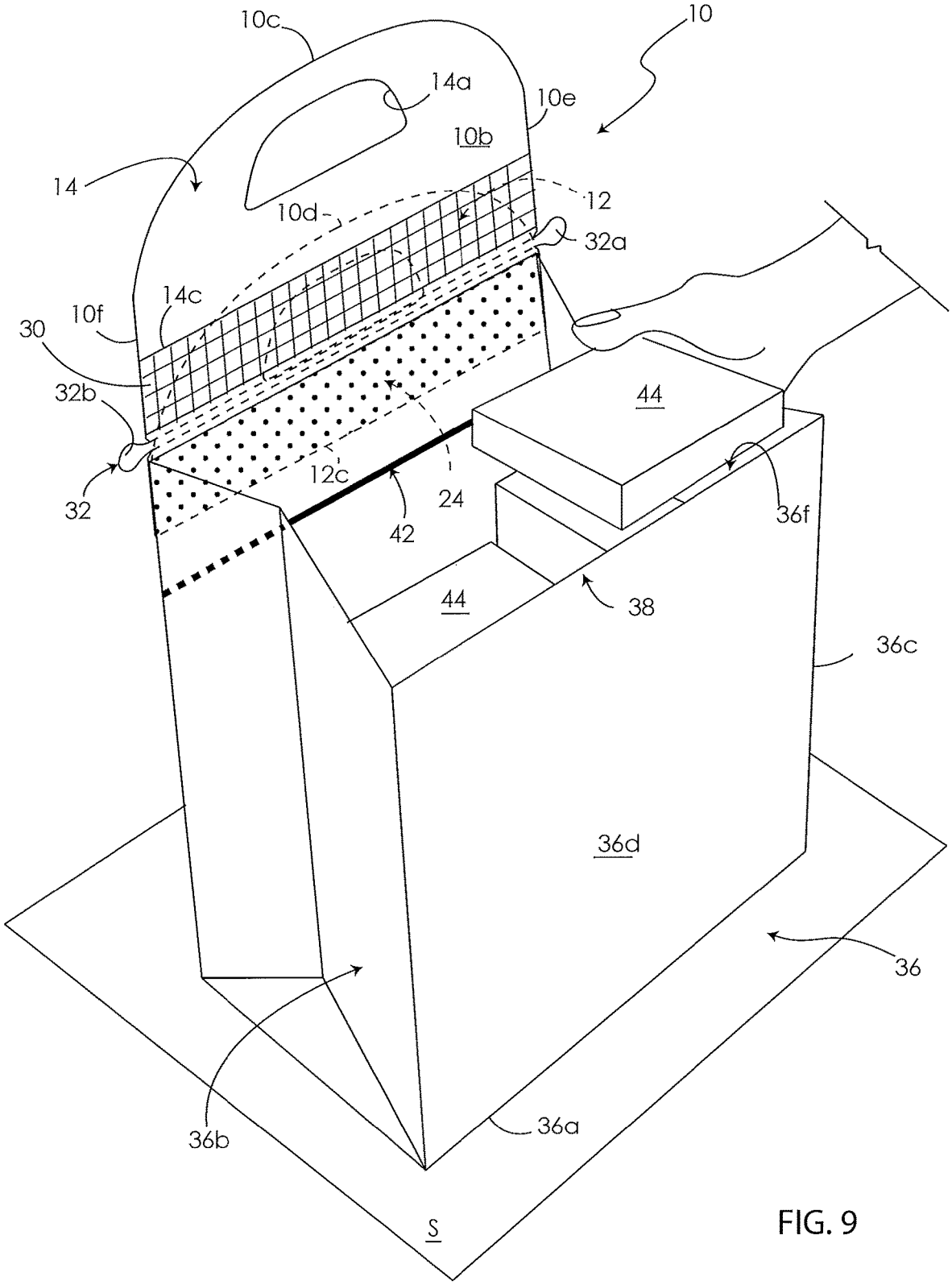
FIG. 9 is a perspective view of the shopping bag shown in an open position and being loaded with merchandise and showing the security handle engaged with the rear wall of the shopping bag.

FIG. 9 shows bag 36 rotated in the opposite direction to arrow "A" (FIG. 7) so that front wall 36*d* of bag 36 faces the user. Bag 36 is moved into an open position and back wall 36*a* of bag 36 is rested on surface "S". Front wall 36*d* is pulled away from back wall 36*e* thereby opening up an interior compartment 36*f* becomes available for use. When bag 36 is in this position the opening to the interior compartment 36*f* is open and unblocked and merchandise 44 may be placed into interior compartment 36*f*. It should be noted that the bag 36 and handle 10 combination illustrated in FIG. 9 is in a configuration that is most suitable for shipping to a customer such as an online retailer or other merchant.

Figure 10:
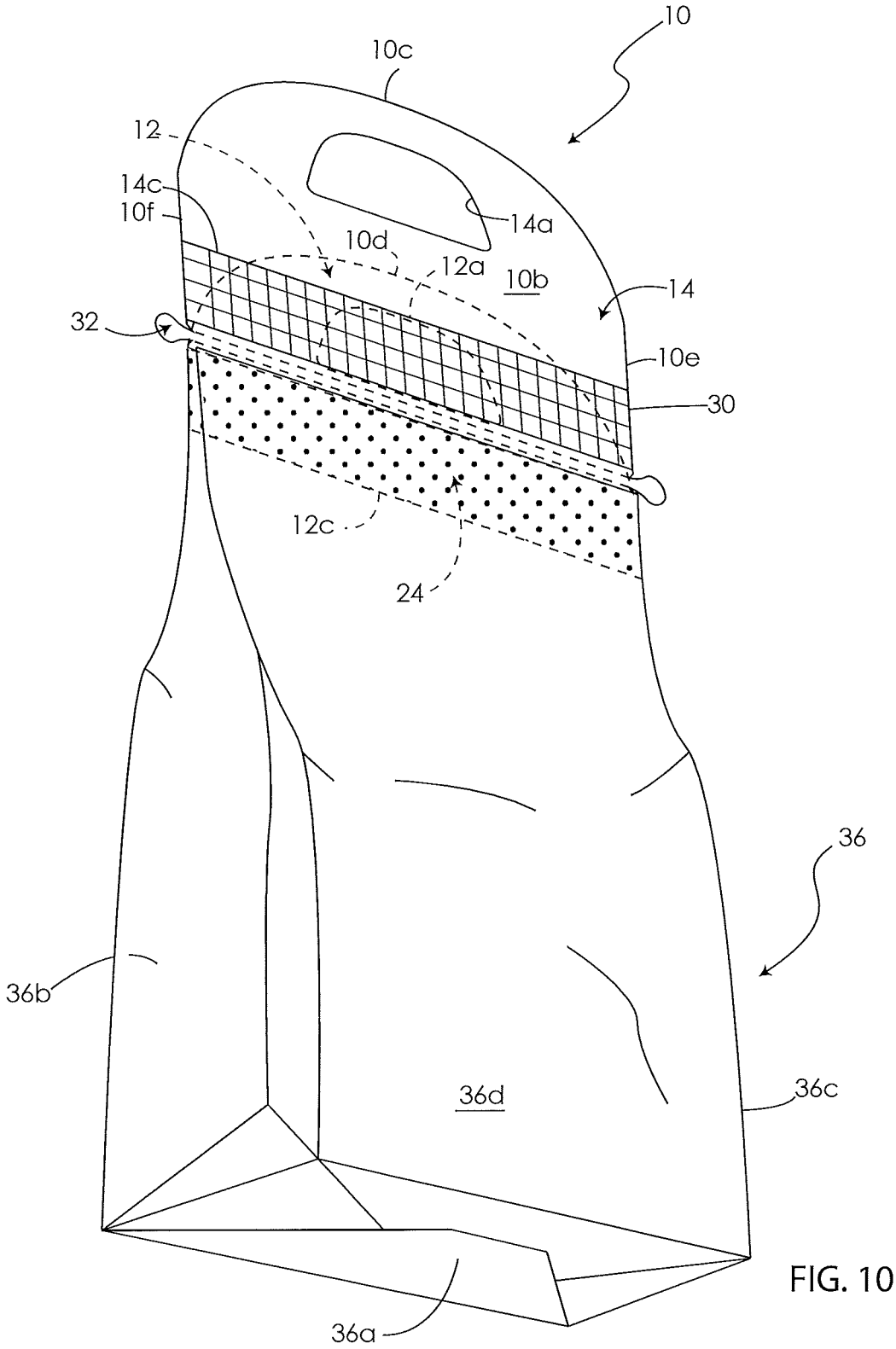
FIG. 10 is a perspective view of the shopping bag moved to a closed position with the security handle shown in the same position as in FIG. 9.

A fill line 42 may be provided on an inside surface of one or more of top, back and side walls 36*d*, 36*e*, 36*b*, 36*c* of bag 36. Fill line 42 may be provided to indicate a maximum level to which bag 36 may be packed with merchandise 44. If merchandise 44 is loaded into interior compartment 36*f* beyond fill line 42, bag 36 may not be able to close to an adequate degree to allow handle 10 to secure and seal bag 36. Once merchandise 44 is loaded into interior compartment 36*f* handle 10 is used to secure and seal bag 36. The securement and sealing of bag 36 requires firstly that the front wall 36*d* and back wall 36*e* be moved toward each other so that the interior surfaces of top regions 38, 40 come into close proximity (FIG. 10).

Figure 11:
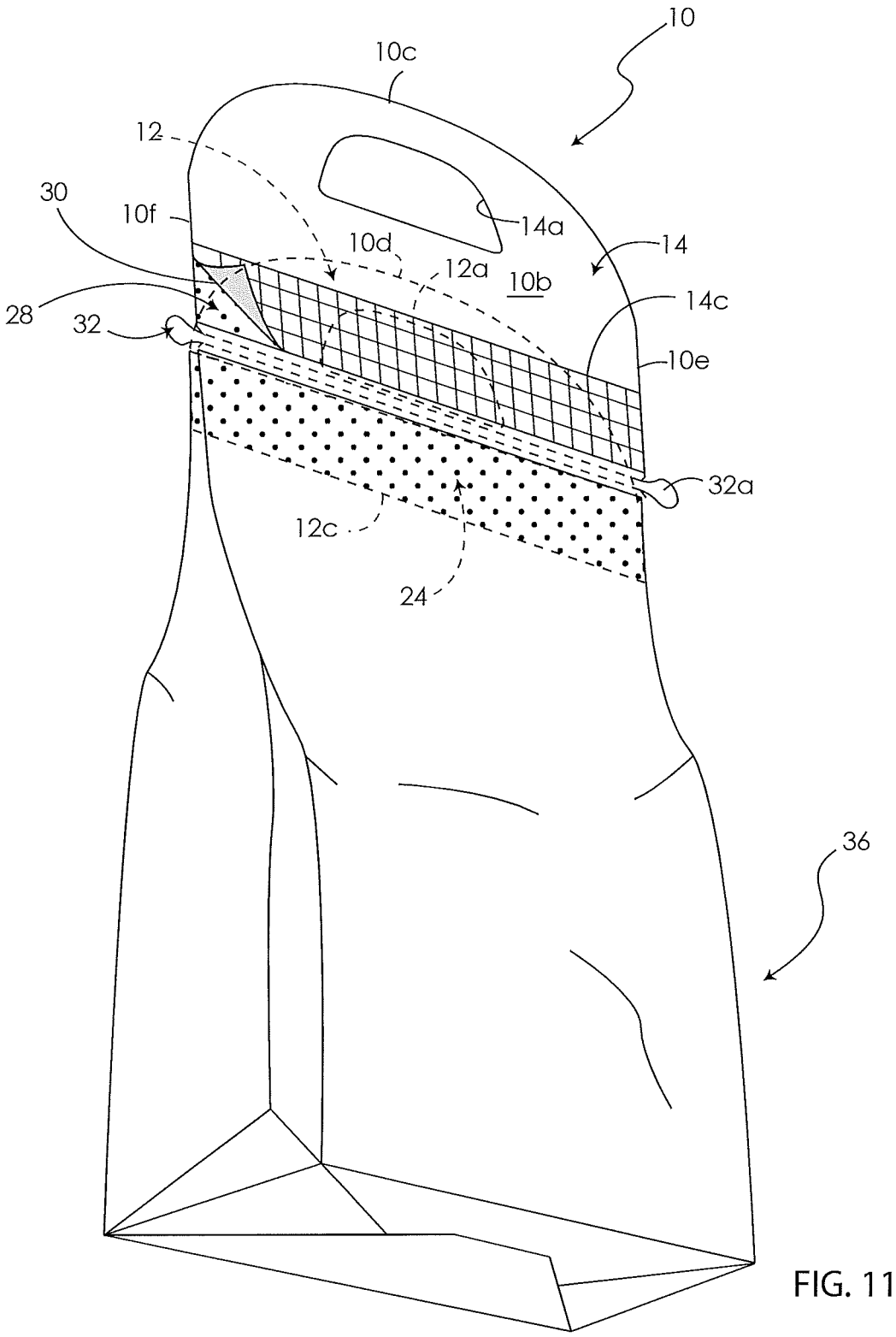
FIG. 11 is a perspective view of the shopping bag as in FIG. 10 but where a protective liner is being removed from an adhesive region on the second handle section.
Figure 12:
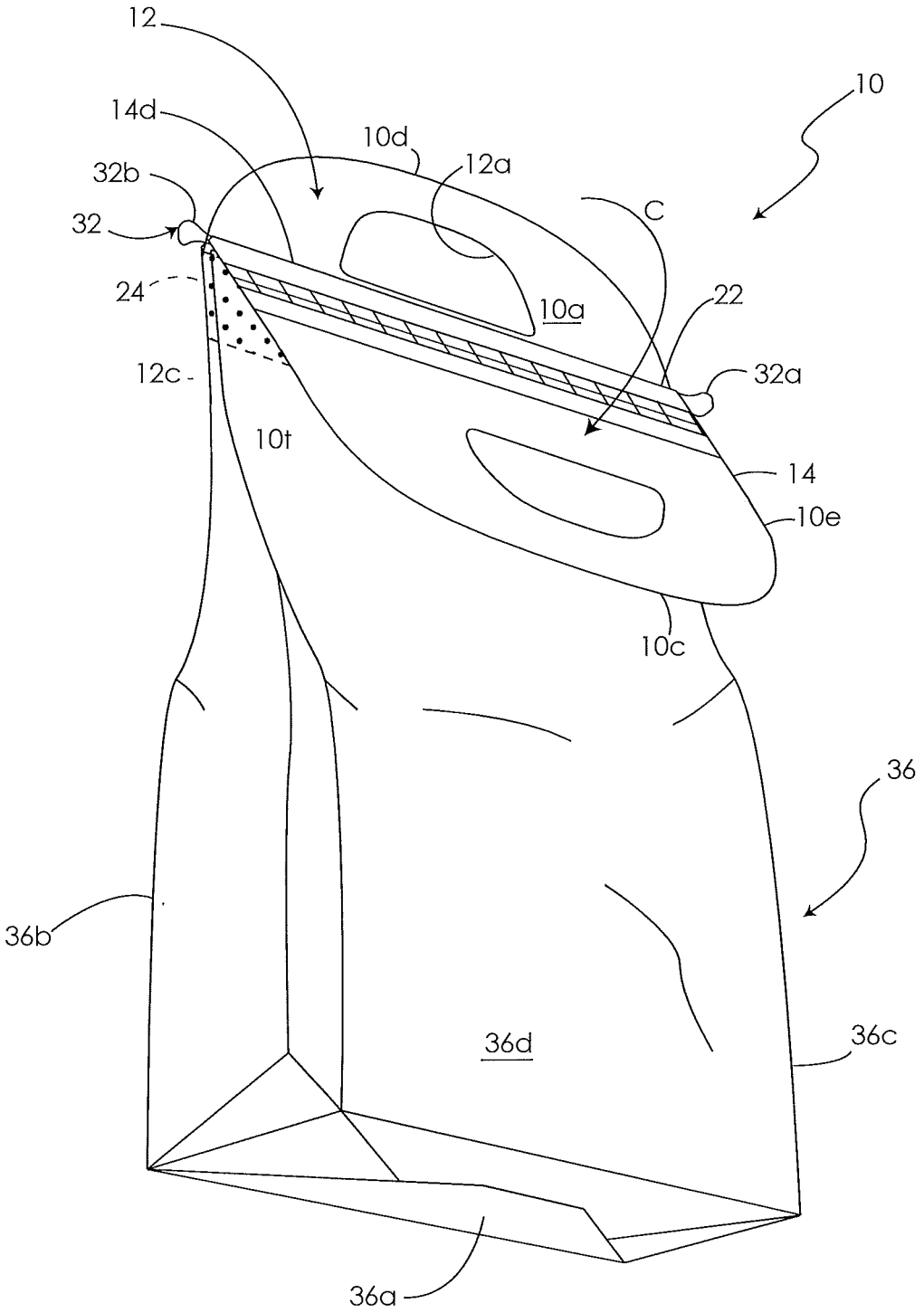
FIG. 12 is a perspective view of the shopping bag as in FIG. 11 where the second handle section is being folded over the upper end of the shopping bag so that the adhesive region on the second handle section adheres to the front wall of the bag and where the frangible zone (i.e., the tear strip) blocks an opening to the interior compartment of the shopping bag.
Figure 13:
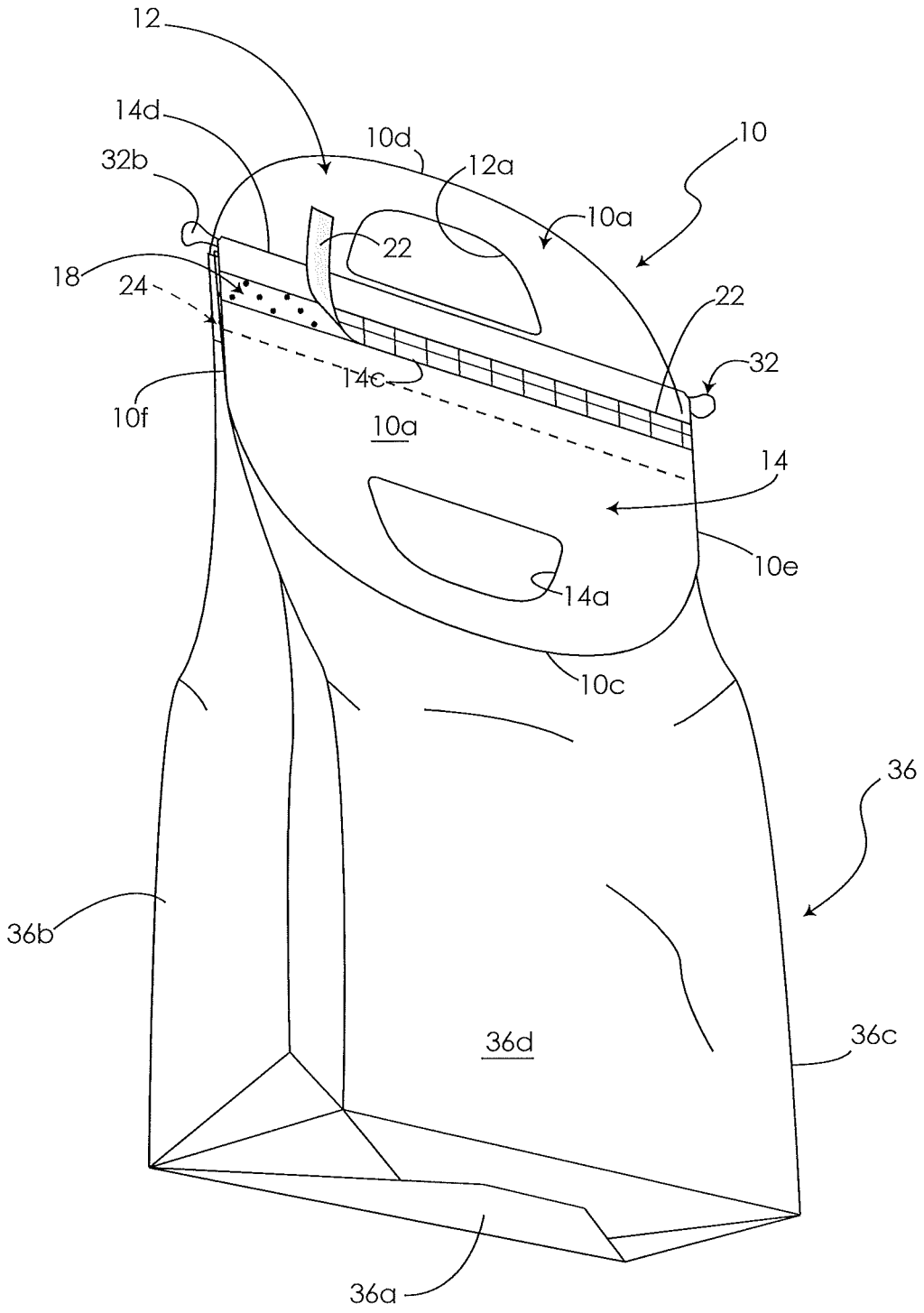
FIG. 13 is a perspective view of the shopping bag where the first and second handle sections are secured to opposite upper ends of the shopping bag's front and rear walls; and showing a protective liner being removed from the adhesive region on the front wall of the second handle section.

FIG. 11 shows that fourth protective liner 30 is then pulled upwardly and is removed from its position over fourth adhesive region 28. Second handle section 14 of handle 10 is then folded along second fold line 14*d* onto front wall of bag 36 by rotating second handle section 14 in the direction of arrow "C" (FIG. 12). FIG. 13 shows second protective liner 22 being pulled upwardly and removed from second adhesive region 18.

Figure 14:
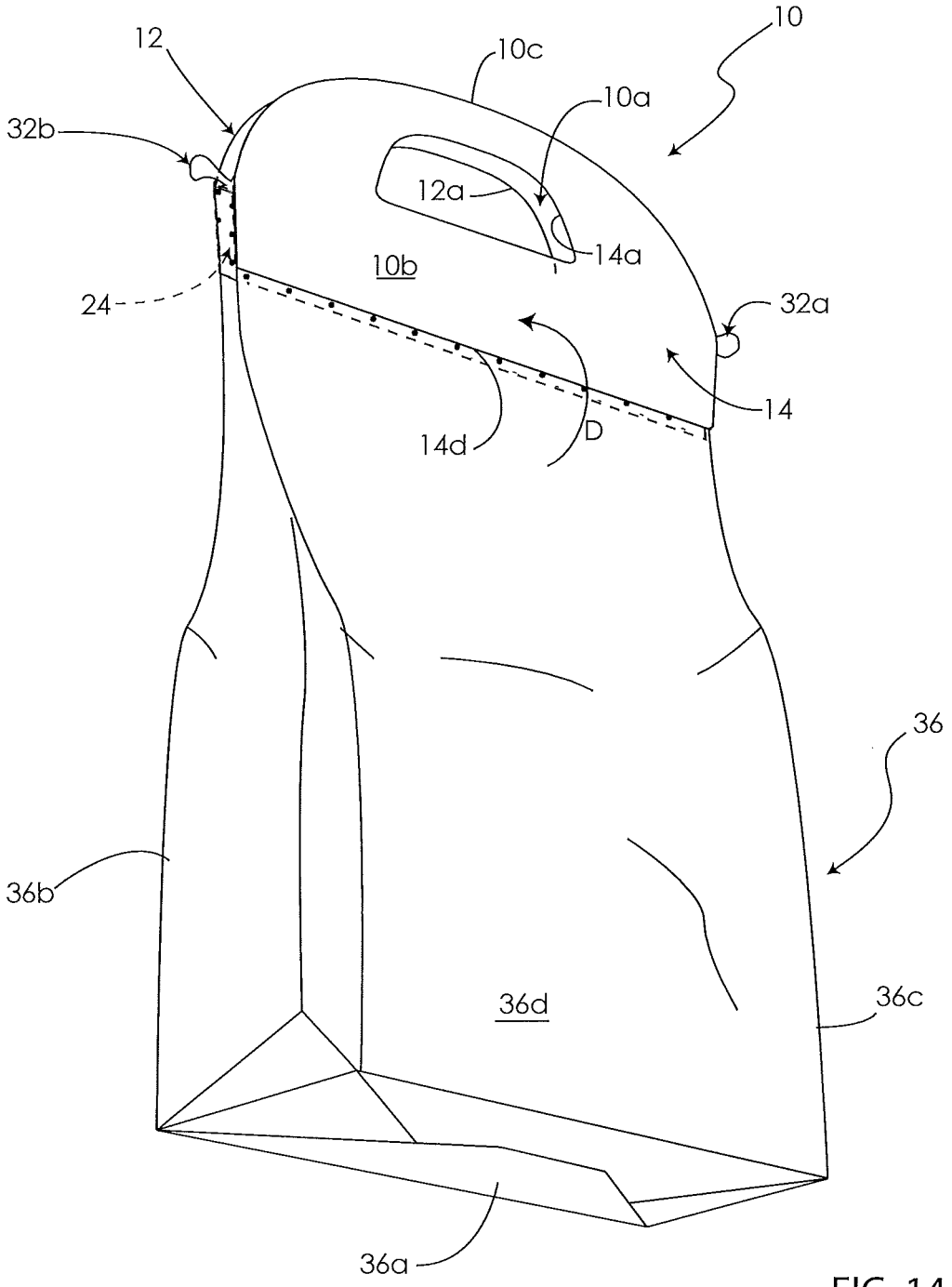
FIG. 14 is a perspective view of the shopping bag showing a part of the second handle section being folded upwardly to engage a remaining part of the second handle section.
Figure 15:
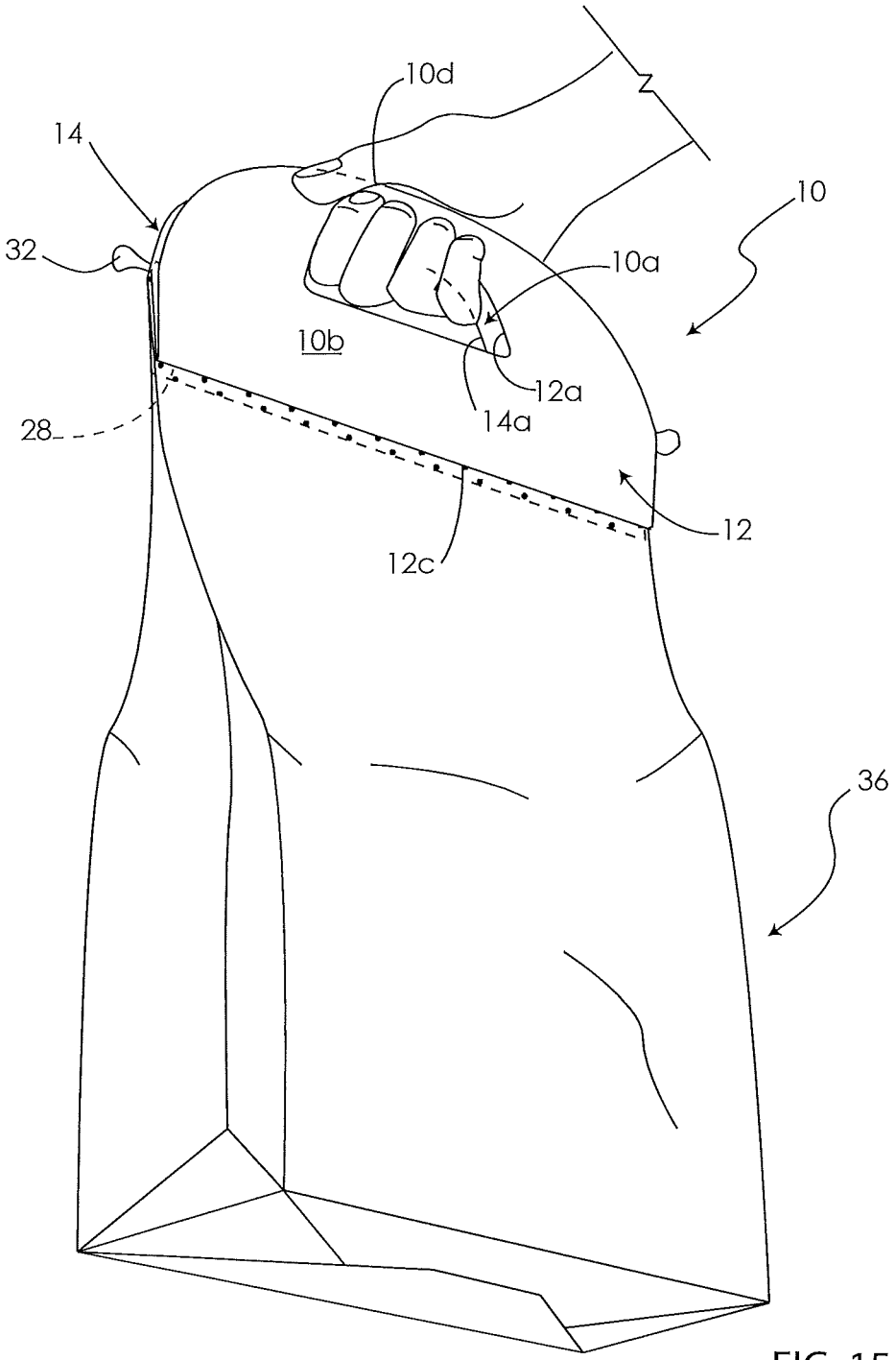
FIG. 15 is a perspective view of the shopping bag showing the bag where the security handle is keeping the bag in a closed and security sealed position and is ready to be carried.

FIG. 14 shows second handle section 14 folded in the direction of arrow "D" to secure part of second handle section 14 to a remaining portion of second handle section 14. The second handle section 14 is then pushed inwardly toward first handle section 12 and this causes the part of second handle section 14 to become adhesively bonded to the remaining portion of second handle section 14 by way of second adhesive region 18. At this point, the opening to interior compartment 36*f* of bag 36 is sealed by handle 10 and the contents are secured therein inasmuch as the various adhesive regions 16, 18, 24 and 28 substantially permanently bond the various parts of first and second handle sections 12, 14 to themselves and to bag 36. First handle section 12 and second handle section are brought into alignment and may then be grasped by a user to carry bag 36. Additionally, pull-tab 32 remains intact at this point and so bag 36 is sealed thereby keeping merchandise 44 within interior compartment 36*f* and preventing tampering with or removal of merchandise 44 from bag 36. Shopping bag 36 may now be carried by way of handle 10. This is accomplished by a user inserting their fingers through the aligned apertures 12*a*, 14*a* as shown in FIG. 15.

Figure 16:
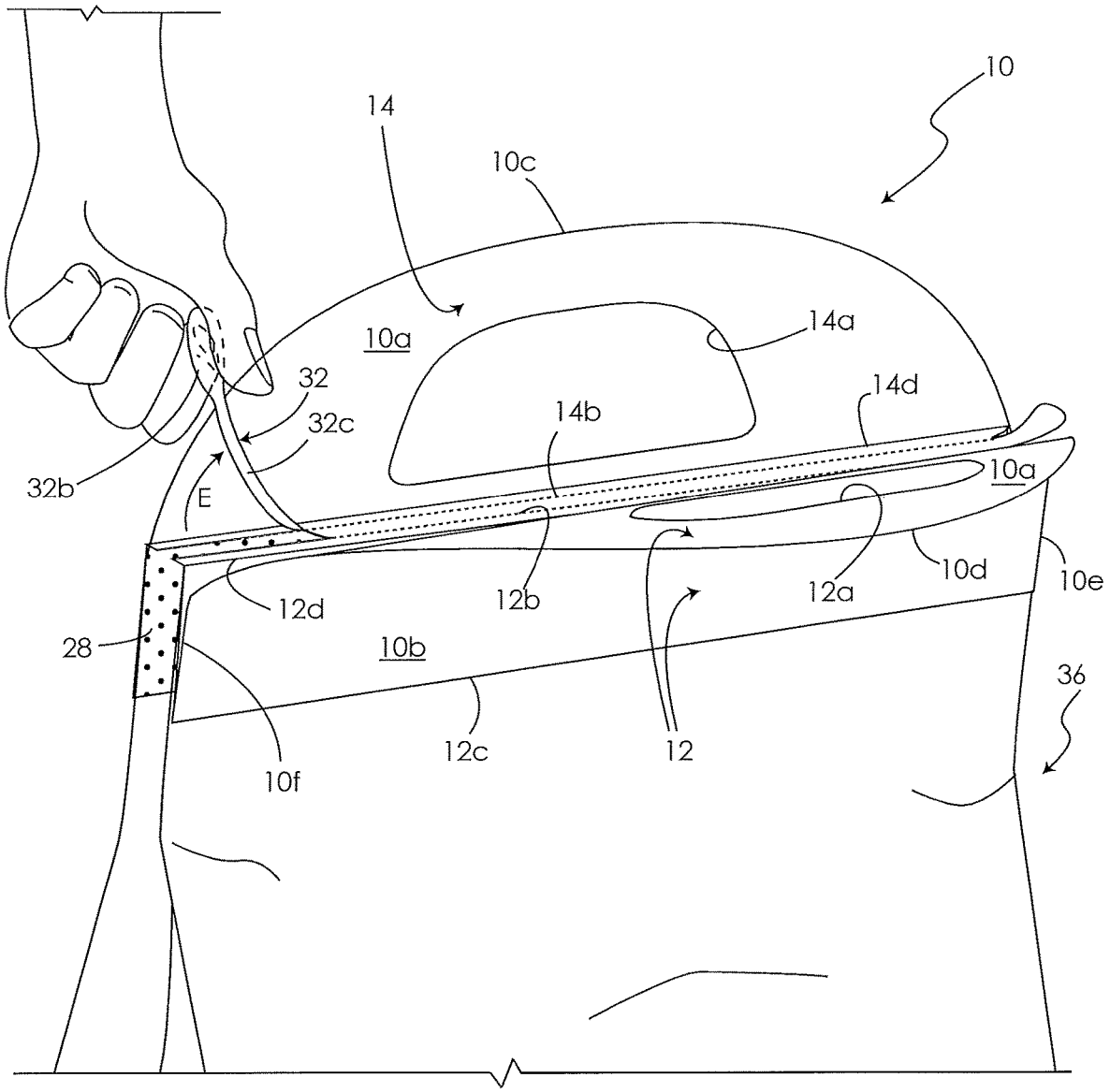
FIG. 16 is a perspective view of the shopping bag showing the first handle section pulled downwardly away from the second handle section and the customer removing a pull tab from the security handle in order to gain access into the interior compartment.

When bag 36 is delivered to the customer, the customer will grasp one or the other of the tabs 32*a*, 32*b* of pull-tab 32 and will pull the same towards the other of the tabs 32*a*, 32*b* as indicated by arrow "E" in FIG. 16. As tab 32*b* (as shown in FIG. 16) is grasped and pulled in the direction of arrow "E", force is applied to the first and second lines of weakness 12*b*, 14*b* and pull-strip 32*c* separates from both of the first and second handle sections 12, 14. A gap 46 (FIG. 16) opens up as pull-tab 32 breaks away from first and second handle sections 12, 14. Pulling on pull-tab 32 thus breaks open the frangible zone on handle 10. Once pull-tab 32 is completely disengaged from handle 10 the customer is able to access the interior 36*f* of bag 36 through the opening defined by the top regions of the front wall, back wall, first and second side walls. Once pull-tab 32 is removed, the customer may move top region 38 of front wall 36*d* of bag and top region 40 of back wall 36*e* away from each other and thereby move bag 36 into the position shown in FIG. 9 so that interior compartment 36*f* and the merchandise 44 therein may be accessed. Merchandise 44 may then be removed from interior compartment 36*f*.

Referring to FIG. 17 there is shown a second embodiment of a security handle in accordance with an aspect of the invention, generally indicated at 110. Handle 110 is substantially identical to handle 10 having a top surface (not shown) and a bottom surface 110*b*, a first end 110*c*, a second end 110*d*, a first edge 110*e* and a second edge 110*f*. Handle 110 is substantially identical to handle 10 except that the first and second adhesive regions 16, 18 and their associated first and second protective liners 20, 22 are omitted from handle 110. Handle 110 comprises a first handle section 112 and second handle section 114 with the third and fourth adhesive regions and their respective third and fourth protective liners 126, 130 being provided on the bottom surface 110*b* of handle 110. First handle section 112 includes an aperture 112*a*, first line of weakness 112*b*, and first and second fold lines 112*c*, 112*d*. Second handle section 114 includes an aperture 114*a*, second line of weakness 112*b*, and first and second fold lines 114*c*, 114*d*. A frangible zone is provided on handle 110 comprising a pull-tab 132 that is removable from handle 110 by tearing first and second lines of weakness 112*b*, 114*b*.

The manner of using handle 110 is substantially identical to the manner of using handle 10. Only the steps of securing a part of the first handle section 112 onto a remaining portion of the first handle section 112 and of securing a part of the second handle section 114 onto a remaining portion of the second handle section 114 are omitted. This is because the first and second adhesive regions 18 and 20 are not present in handle 110.

Referring to FIG. 18, there is shown a third embodiment of the security handle, generally indicated at 210. Handle 210 may be substantially identical to handle 10 or to handle 110; i.e., handle 210 may include first and second adhesive regions or they may be omitted therefrom. Handle 210 differs from each of the handles 10 and 110 in that the pull-tab 232 provided in the frangible zone of handle 210 only has a single tab 232*a* at one end of pull-strip 232*c*. Apart from this, handle 210 is substantially identical to handle 10 or 110 having a top surface (not shown) and a bottom surface 210*b*, a first end 210*c*, a second end 210*d*, a first edge 210*e* and a second edge 210*f*. Handle 210 comprises a first handle section 212 and second handle section 214 with the third and fourth adhesive regions and their respective third and fourth protective liners 226, 230 being provided on the bottom surface 210*b* of handle 210. First handle section 212 includes an aperture 212*a*, first line of weakness 212*b*, and first and second fold lines 212*c*, 212*d*. Second handle section 214 includes an aperture 214*a*, second line of weakness 212*b*, and first and second fold lines 214*c*, 214*d*. A frangible zone is provided on handle 210 comprising pull-tab 232 that is removable from handle 210 by grasping the single tab 232*a* and tearing first and second lines of weakness 212*b*, 214*b*.

Figure 19:
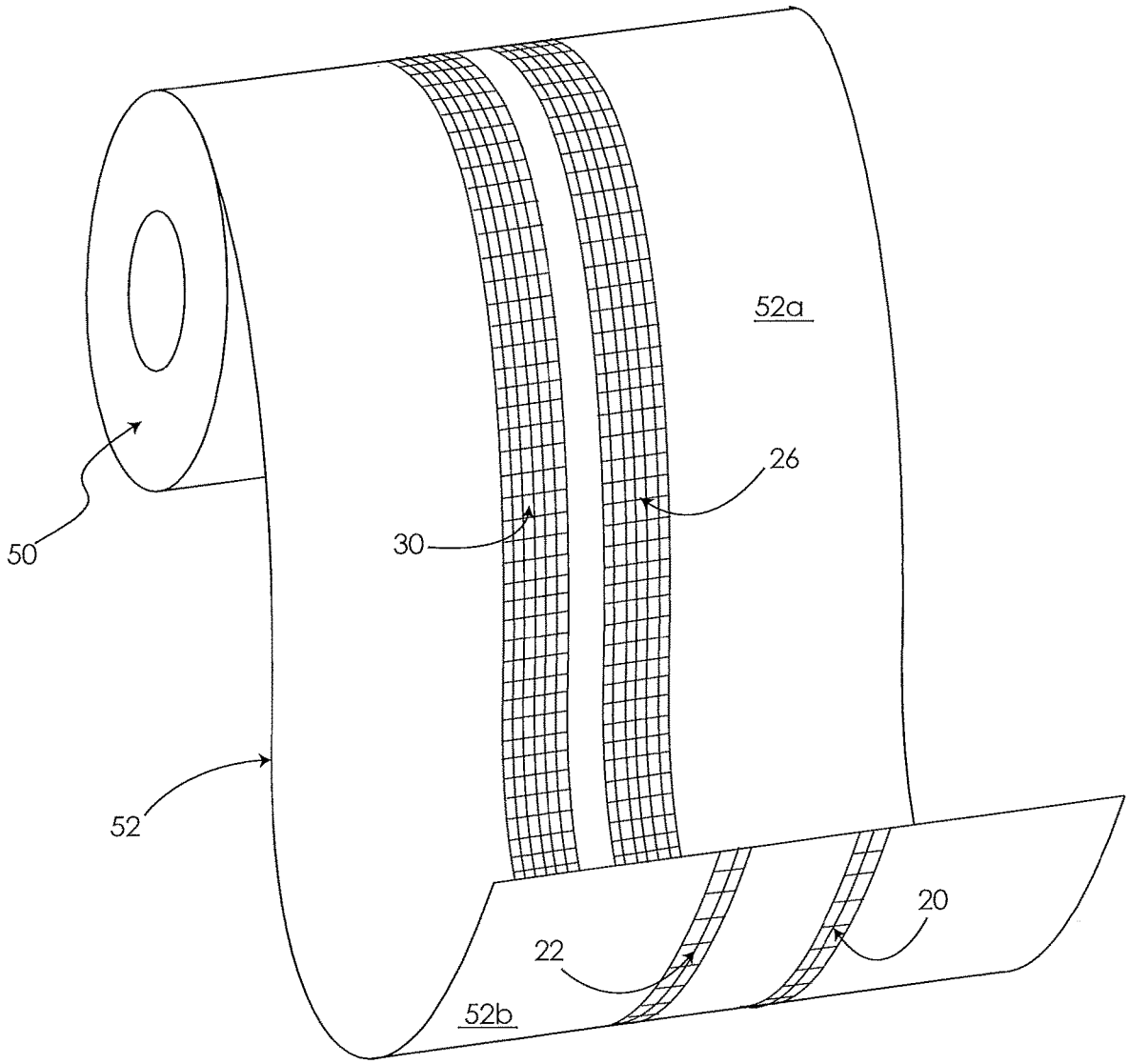
FIG. 19 is a perspective view of a first roll of material for fabricating the security handle and showing first and second adhesive regions with protective liners thereover running longitudinally along a front wall of the material and third and second adhesive regions with protective liners thereover running longitudinally along a back wall of the material.
Figure 20:
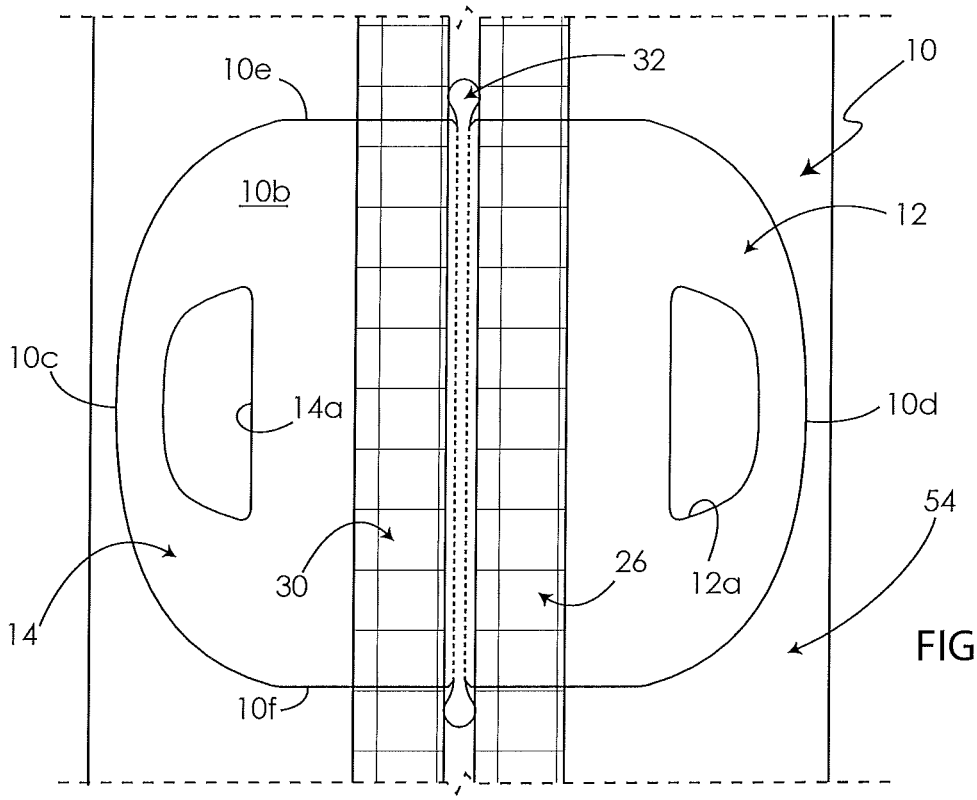
FIG. 20 is a bottom plan view of a die-cut handle where the roll of material of FIG. 19 is used to apply adhesive strips to a rear surface of the handle.
Figure 21:
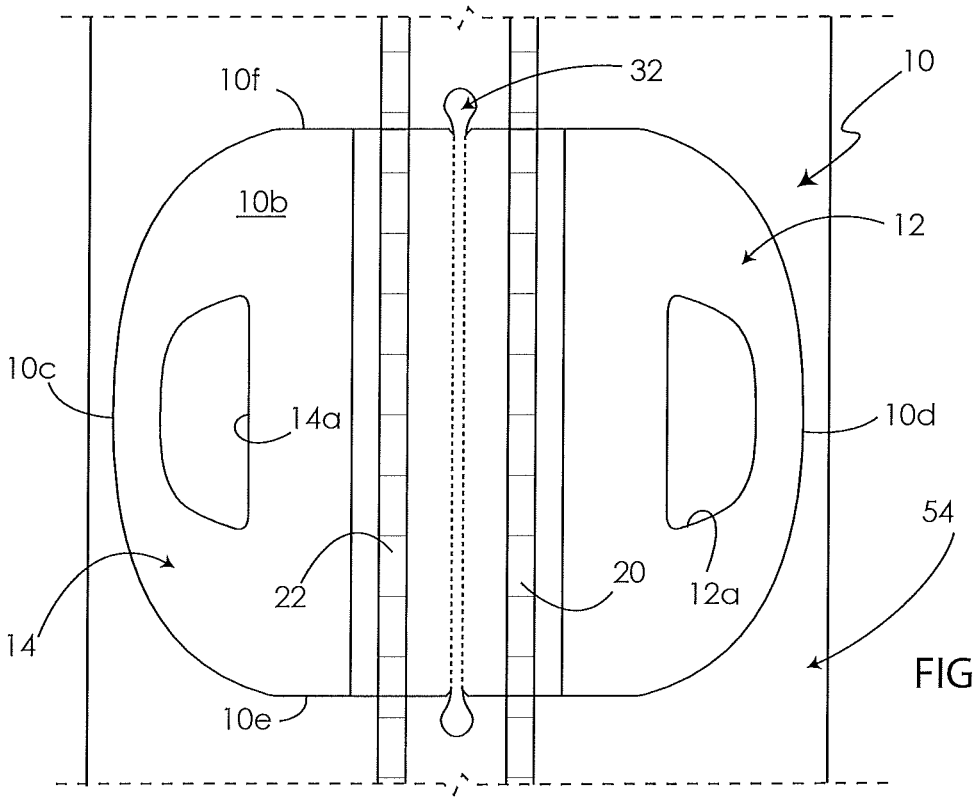
FIG. 21 is a top plan view of the die-cut handle where the roll of material of FIG. 19 is used to apply adhesive strips to a top surface of the handle.

Referring to FIGS. 19-21 there is shown a first possible method of fabricating handle 10 (and handles 110 and 210). FIG. 19 shows a roll 50 that includes a length of sheet material or film 52 wound thereon, i.e., rollstock 52 upon which may be applied the first, second, third and fourth adhesive regions. Rollstock 52 has an upper surface 52*a* and a lower surface 52*b*. The first and second adhesive regions may be applied on lower surface 52*b* in such a way that the adhesive regions are laterally spaced from each other and extend longitudinally along the length of rollstock 52. Similarly, the third and fourth adhesive regions may be applied on upper surface 52*a* such that these regions are laterally spaced from each other and extend longitudinally along the length of rollstock 52. In other words, each of the first, second, third and fourth regions runs parallel to a longitudinal axis of rollstock 52, where that axis is substantially parallel to the side edges of the film and intersects the front and back edges of the film. The third and fourth adhesive regions are positioned to overlap those parts of rollstock 52 upon which first and second adhesive regions have been applied. Protective liners 20, 22, 26 and 30 are applied over the first, second, third and fourth adhesive regions.

In other instances, the application of the adhesive regions and protective liners onto rollstock 52 may be one-sided only instead of double-sided. So, only the first and second adhesive regions may be applied to the rollstock or only the third and fourth adhesive regions may be applied to rollstock and then the two different rolls of film will be used during the fabrication of handle 10.

FIGS. 20 and 21 show a die-cut handle 10 on rollstock 52 where handle 10 may be supported on a conveyor 54 or other surface and positioned such that the rollstock 52 passes thereover and applies the third and fourth adhesive regions and protective liners 26, 30 (FIG. 20) to bottom surface 10*b* in a first run. FIG. 21 shows die-cut handle 10, rotated through 180° and positioned on rollstock 52 so that first and second adhesive regions and their associated protective liners 20, 22 may be applied to the top surface 10*a* of the handle 10.

Figure 22:
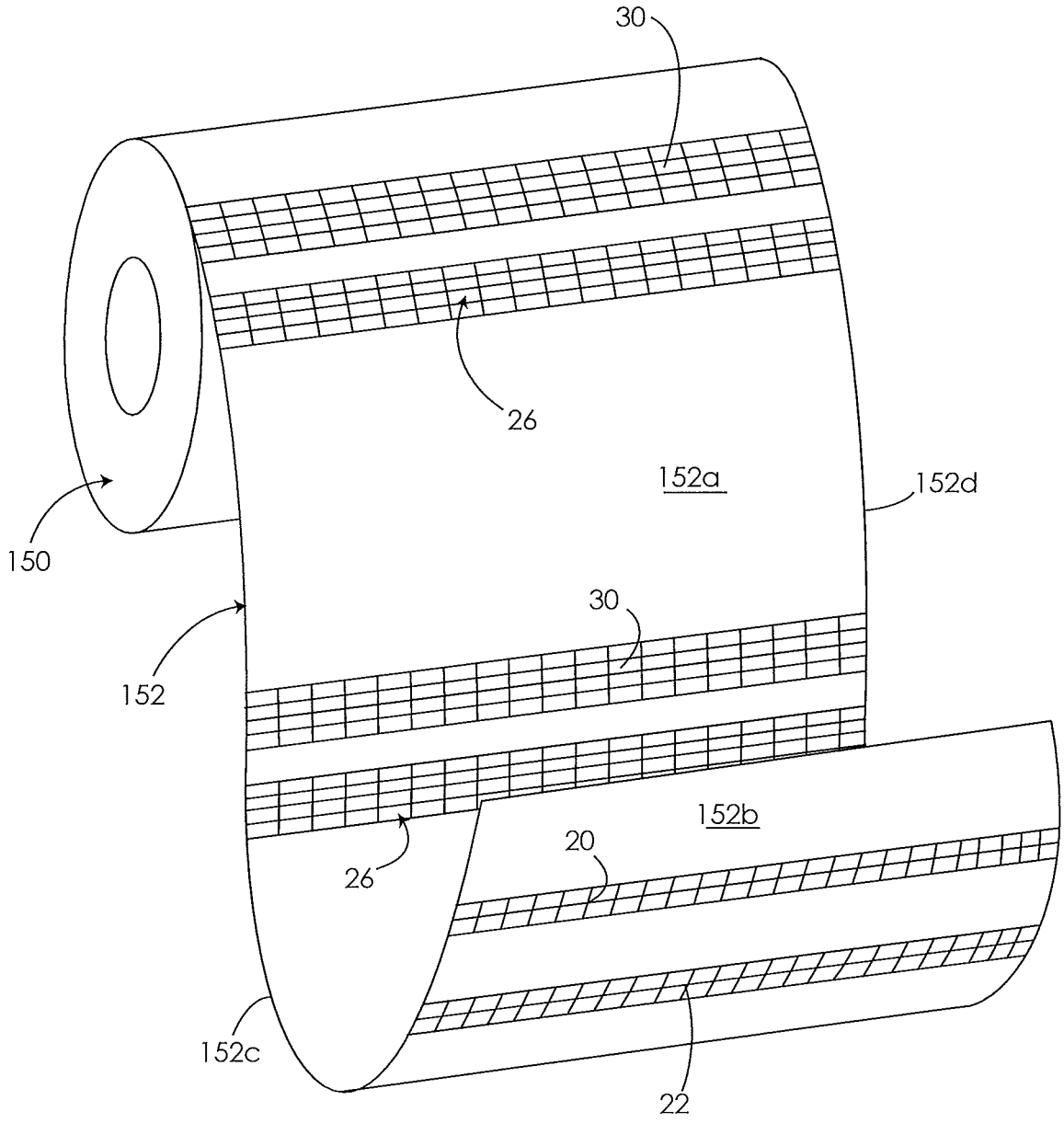
FIG. 22 is perspective view of an alternative embodiment of a roll of material where first and second adhesive regions are horizontally oriented on an upper surface of the material at spaced intervals; and third and fourth adhesive regions are horizontally oriented on a lower surface of the material at spaced intervals
Figure 23:
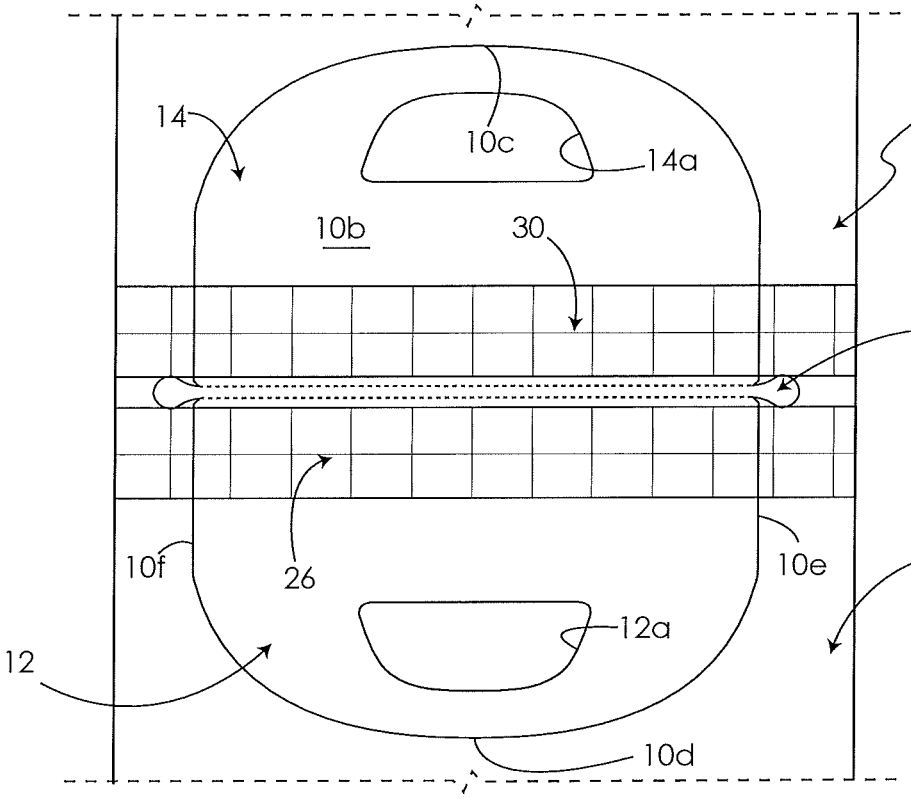
FIG. 23 is a bottom plan view of a die-cut handle where the roll of material of FIG. 22 is used to apply adhesive strips to a rear surface of the handle.
Figure 24:
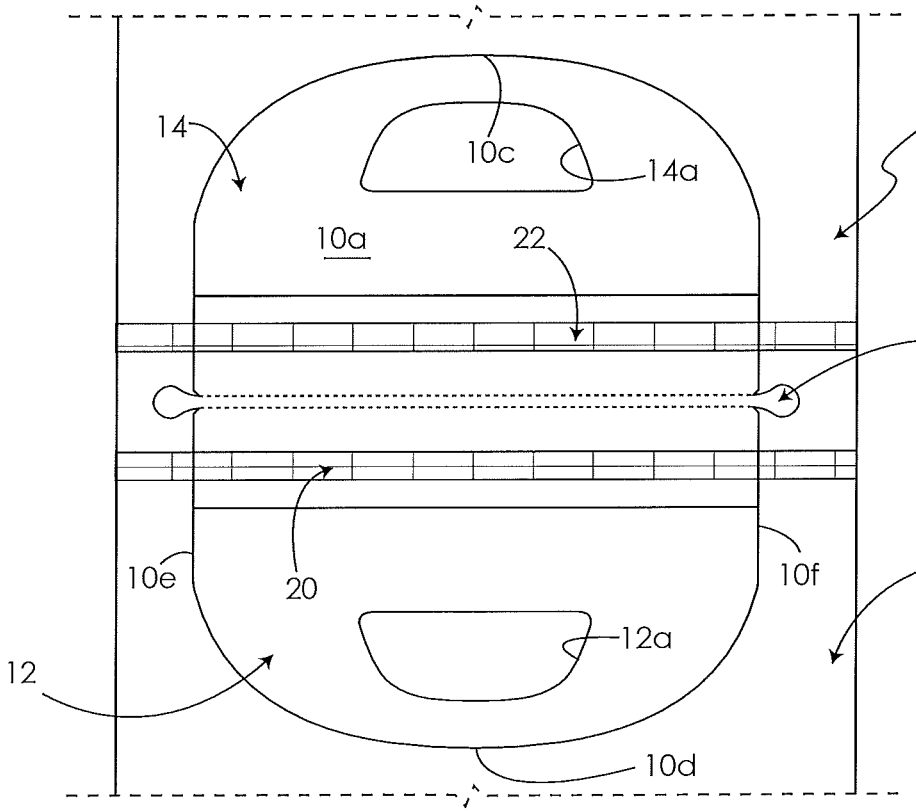
FIG. 24 is a top plan view of the die-cut handle where the roll of material of FIG. 22 is used to apply adhesive strips to a top surface of the handle.

FIGS. 22-24 show a different method of production in which a roll 150 of sheet material or film, i.e. rollstock 152 has first and second adhesive regions and their associated protective liners 20, 22, and third and fourth adhesive regions and their associated protective liners 26, 30 applied on opposed surfaces 152*a*, 152*b*. Rollstock 152 differs from rollstock 52 in that the adhesive regions are oriented at right angles relative to the longitudinal axis of the rollstock 152, where the longitudinal axis runs along the length of the film parallel to the side edges and intersecting the top edge region. In rollstock 152, the adhesive strips run from one side edge 152*c* of the film to the other side edge 152*d*, i.e. across the width of the rollstock 152. FIGS. 23 and 24 show the differently oriented adhesive regions and their associated strips 20, 22, 26 and 30 being applied to the two different surfaces 10*a*, 10*b* of handle 10 while positioned on a conveyor or other surface 54. Rollstock 152 may be required if an oriented or anisotropic polymer is used as the maximum strength or stiffness of such material is along the roll length.

It will be understood that any other suitable method of fabricating handle 10, such as utilizing other known methods of applying adhesive regions 18, 20, 24 and 28 thereto with their associated protective liners 20, 22, 26 and 30, may be utilized including apply adhesive in different ways to opposing surfaces 10*a*, 10*b* of handle 10.

It will be further understood that in some instances handles may be applied to bags as part of an automated or semi-automated process in which merchandise is packaged on a line. In these instances, the first adhesive region may be applied to the handle and the handle secured to a top or bottom surface of the bag 36; the bag may then be filled with merchandise and moved to a closed position; an adhesive region may be applied in the next appropriate location on the handle which is then manipulated and folded so that the handle closes and secures the bag in the closed position. Alternatively, the some or all of the adhesive regions may be applied to handle 10 but some or all of the protective liners may be omitted if the handle 10 is assembled and utilized in the same process.

It will be understood that instead of pull-tab 32 that is integrally formed with first and second handle sections 12, 14, other types of tamper-proof opener members may be utilized that are separate components that are used to a separate first handle section to a separate second handle section. In other words, the handle may be comprised of three discrete components that are joined together to form the handle that is then applied to the bag.

It will further be understood that instead of folding first and second handle sections 12, 14 along fold lines 12*d*, 14*d*, one or both of the first and second fold handle sections may be folded along one or both of first and second lines of weakness 12*b*, 14*b* in order to move the handle 10 into the W-shaped configuration shown in FIG. 3. So, for example, the method of moving the handle 10 from the position shown in FIG. 6 may include the steps of bending the second handle section 14 along second line of weakness 14*b*, bending the first and second handle sections 12, 14 along fold lines 12*c* and 14*c*; engaging the handle sections 12, 14 using adhesive strips 16 and 18. The first handle section 12 will adhere to the bag 36 using first adhesive region 24, the bag 36 will be opened and filled and then be sealed by adhering adhesive region 28 to the bag 36.

Referring to FIGS. 25-31, there is shown a bag assembly in accordance with an aspect of the present invention, generally indicated at 310. Bag assembly 310 comprises a bag 312 and a fourth embodiment of a handle assembly 314 that is engaged with bag 312.

Figure 25:
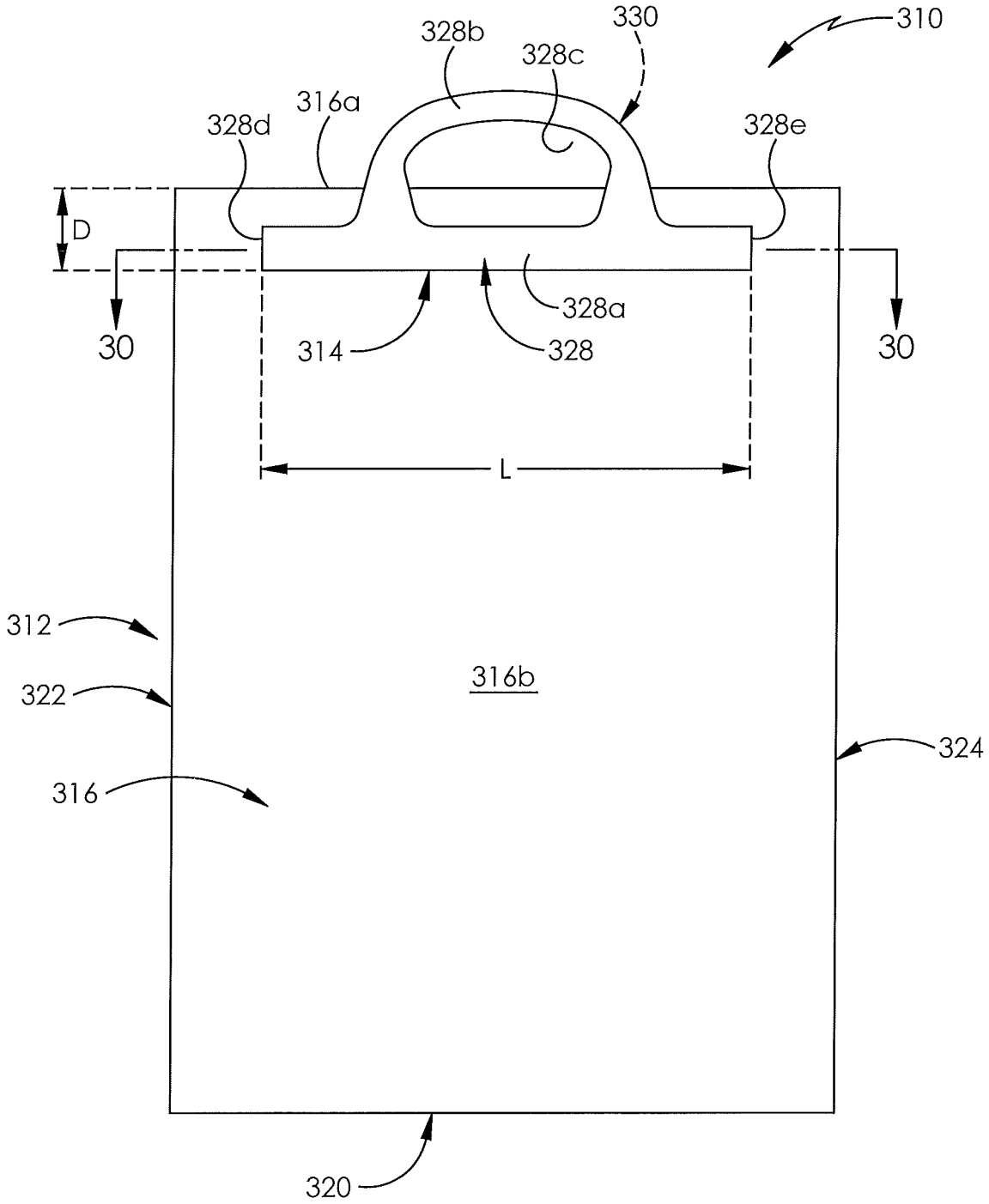
FIG. 25 is a front view of a bag assembly including a fourth embodiment of a handle in accordance with an aspect of the present invention.
Figure 26:
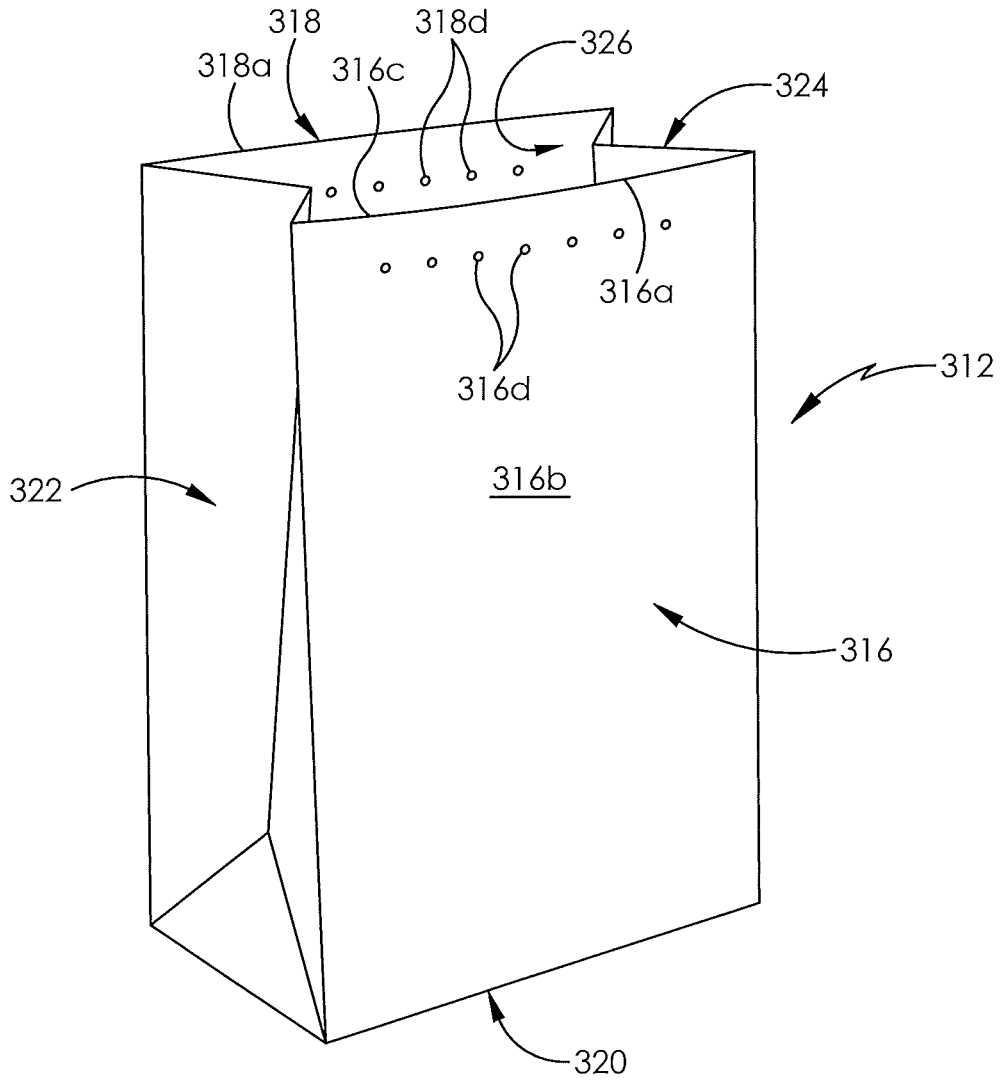
FIG. 26 is a perspective view of the paper bag shown alone.

It will be understood that the bag assembly 310 illustrated in FIGS. 25 and 26 is an example of a bag assembly 310 in accordance with an aspect of the present invention. The actual shape and size of bag 312 may be varied and the specifics of handle assembly 314, described hereafter, may also be varied. Bag 312 may be a paper bag made from any suitable type of paper-based product including but not limited to Kraft paper, corrugated cardboard, and card stock. Additionally a biodegradable material or recyclable filler may be utilized in the paper-based product or instead of the paper-based product. Bag 312 may be of a size and of sufficient strength to carry up to about ten kilograms (twenty pounds) of products or goods therein.

Handle assembly 314 may be fabricated from any suitable material such as injection-molded plastic and is contemplated to be generally rigid in nature so that it has suitable strength and durability. The handle assembly 314, while being generally rigid, may also be somewhat flexible. It is contemplated that handle assembly 314 may be temporarily engaged with bag 312 and when bag 312 starts to break down from use, handle assembly 314 may be disengaged therefrom and reengaged with another paper bag in a similar fashion to what is described herein.

As illustrated in FIG. 26, bag 312 may include a front wall 316, a back wall 318, a bottom wall 320 and first and second side walls 322, 324. Each of the front wall and back wall 316, 318 has a lower end that engages bottom wall 320 and an upper end that is located remote from bottom wall 320. The upper ends 316*a*, 318*a* of front wall and back wall 316, 318 are identified in FIG. 26. It should be noted that the upper ends 316*a*, 318*a* of front wall and back wall 316, 318 may be of a thickness (between the exterior surface 316*b*, and interior surface 316*c*) that is of a similar thickness to the rest of front wall 316 or back wall 318. Alternatively, the upper end of each of the front wall and back wall 316, 318 may be folded over so that the upper ends 316*a*, 318*a* are of a double thickness relative to the rest of front wall and back wall 316, 318. First side wall 322 extends between a first side edge of front wall 316 and a first side edge of back wall 318 and is engaged along its lower end to bottom wall 320. Second side wall 324 extends between a second side edge of front wall 316 and a second side edge of back wall 318 and is engaged along its lower end to bottom wall 320. Front wall 316, back wall 318, bottom wall 320 and first and second side walls 322, 324 bound and define a compartment 326 that is accessible through an opening defined by the upper ends of front, back and side walls 316, 318, 322, 324, those upper ends including upper end 316*a* and upper end 318*a*. Goods and products to be carried in bag assembly 310 are received within compartment 326. A plurality of holes 316*d* may be defined in front wall 316 and a corresponding plurality of apertures 318*d* may be defined in back wall 318. Holes 316*d*, 318*d* are utilized to engage handle 314 to bag 312 as will be described hereafter.

Handle assembly 314 may be comprised of two handle sections; a first handle section is engageable with front wall 316 and a second handle section is engageable with back wall 318. These first and second handle sections may be substantially identical to each other in structure, function and in the manner in which they are engageable with the respective front wall 316 or back wall 318. Each handle section in turn may be comprised of one or two handle members such as the first handle member 328 and the second handle member 330 illustrated in FIG. 27. First and second handle members 328, 330 may be substantially identical to each other but may also be configured in such a way that they can be interlockingly engaged with each other and capture a section of the front wall 316 or back wall 318 of bag 312 therebetween. The specific shape, size and manner in which first and second handle members 328, 330 are molded may vary and it should be understood that FIGS. 27, 28 and 29 show exemplary versions of the types of handle sections that may be engaged with bag 312.

Figure 27:
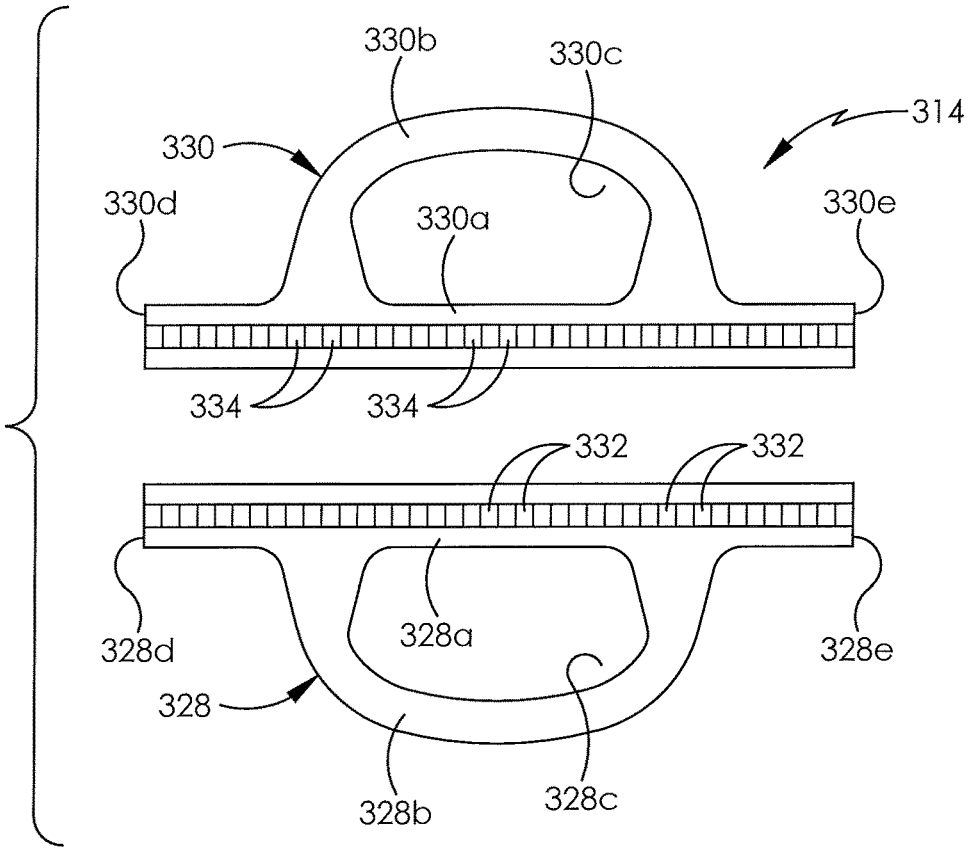
FIG. 27 is a top view of the fourth embodiment of the handle in accordance with an aspect of the present invention showing a first handle section made up from a pair of handle members shown positioned adjacent each other on a flat surface.

FIG. 27 shows first handle member 328 and second handle member 330 that are substantially mirror images of each other. First and second handle members 328, 330 are designed to selectively and releasably engage each other and releasably capture a section of bag 312 between them. First handle member 328 includes a base 328*a* with a flange 328*b* extending outwardly therefrom. The flange 328*b* may be U-shaped or of any other desired shape. Flange 328*b* and a section of base 328*a* bound and define a first hole 328*c*. A person will eventually insert their fingers through hole 328*c* once first handle member 328 is engaged with bag 312. Base 328*a* and flange 328*b* may be of substantially the same thickness or may be of different thicknesses, where the thickness of each of the base and flange is measured between an interior surface (such as the surface of the base 328*a* that contacts one of the surfaces of the bag's front or back wall 316, 318) and an exterior surface of the base or flange. Second handle member 330 includes a base 330*a* with a flange 330*b* extending outwardly therefrom. Flange 330*b* may be U-shaped or any other shape that is complementary to flange 328*b*. Flange 330*b* and a section of base 330*a* bound and define a second hole 330*c* that aligns with hole 328*c* when second handle member 330 is engaged with bag 312. The person holding bag 312 will insert their fingers through the aligned holes 328*c*, 330*c* in order to hold bag 312 using handle 314. Handle assembly 314 has a length "L" measured from aligned first sides 328*d*, 330*d* to aligned second sides 328*e*, 330*e*. That length "L" may be of any desired size but a length of 9.75 inches" has been found to be suitable for a number of different size bags 312. The length of handle assembly 314 may be selected to be of a size sufficient to adequately spread the load over a wider region of bag 310.

First handle member 328 may be positioned adjacent an exterior surface 316*b* of front wall 316 and second handle member 330 may be positioned adjacent an interior surface 316*c* of front wall 316. The bases 328*a*, 330*a* are positioned so as to be aligned horizontally with each other and so that a lowermost edge of the two bases 328*a*, 330*a* are located a distance "D" (FIG. 25) downwardly from upper end 316*a* of front wall 316. The bases 328*a*, 330*a* are position so that at least a portion of the hole 328*c* is located above upper end 316*a* of front wall 316, as is illustrated in FIG. 25. The sides 328*d*, 328*e* of first handle member 328 are aligned with the sides 330*d*, 330*e* of second handle member 330. First and second handle members 328, 330 are also each respectively provided with one or more and preferably a plurality of teeth 332, 334 on a bag-contacting surface thereof. Teeth 332 and teeth 334 are configured to interlockingly engage each other and thereby capture front wall 316 therebetween.

Figure 28:
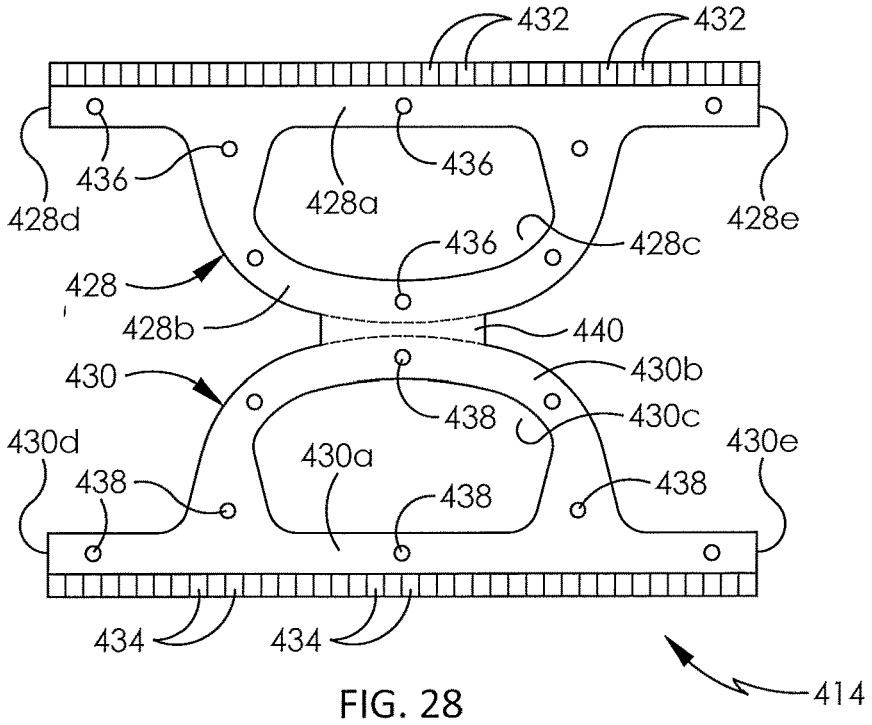
FIG. 28 is a top view of a fifth embodiment of the first handle section made up from a pair of handle members shown laying on a flat surface.
Figure 29:
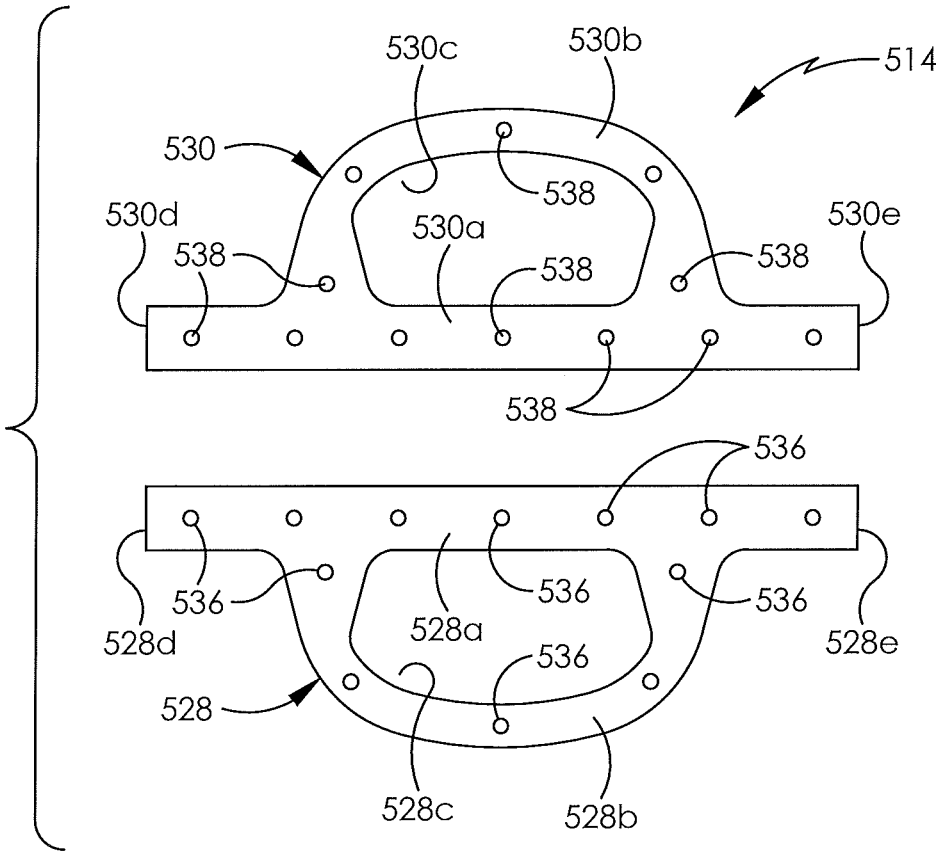
FIG. 29 is a top view of a sixth embodiment of the first handle section made up from a pair of handle members shown laying on a flat surface.

FIG. 28 shows a fifth embodiment of a first handle section that may be engaged with front wall 316. First handle section comprises a first handle member 428 and second handle member 430 that are substantially mirror images of each other. First handle member 428 includes a base 428*a*, a U-shaped flange 428*b* and the flange 428*b* and a section of base 428*a* bounds and defines a hole 428*c*. First handle member 428 also includes sides 428*d* and 428*e*. Second handle member 430 includes a base 430*a*, a U-shaped flange 430*b* and the flange 430*b* and a section of base 430*a* bound and define a hole 430*c* therein. First handle member 428 may be positioned adjacent an exterior surface 316*b* of front wall 316 and second handle member 430 may be positioned adjacent an interior surface 316*c* of front wall 316. The bases 428*a*, 430*a* are positioned so as to be aligned horizontally with each other and so that a lowermost edge of the two bases 428*a*, 430*a* are located a distance downwardly from upper end 316*a* of front wall 316 in a similar manner to how first and second handle members 328, 330 engage front wall 316. The sides 428*d*, 428*e* of first handle member 428 are aligned with the sides 430*d*, 430*e* of second handle member 430. First and second handle members 428, 430 are also each respectively provided with a plurality of teeth 432, 434 on a bag-contacting surface thereof. Teeth 432 and teeth 434 are configured to interlockingly engage each other and thereby capture front wall 316 therebetween. In addition to teeth 432, 434, first and second handle members 428, 430 also include one or more pins 436 and one or more complementary receptors 438. Pins 436 are configured to be received within receptors 438. Pins 436 are inserted through holes 316*d* defined in front wall 316 or may actually be used to pierce holes 316*d* through front wall 316. Receptors 438 may take any form that is suitable to interlockingly engage and retain pin 436. So, for example, receptors 438 may comprise tubular holes that are of slightly smaller in dimension than pins 436. It will be understood that some of pins 436 may be provided on first handle member 428 and some of the receptors 438 may also be provided on first handle member 430 and the complementary pins 436 and receptors are located in appropriate complementary positions on the opposite first or second handle member 428, 430. Alternatively, all the pins 436 may be on the first handle member 428 and all the receptors 438 may be on the second handle member 430 or vice versa. The pins 436 and receptors 438 may be located at any suitable position along base 428*a*, 430*a* or flange 428*b*, 430*b*.

FIG. 28 also illustrates another possible feature of one of the handle sections, that being that the two flanges 428*b*, 430*b* are joined to each other along one edge and form a living hinge 440. Hinge 440 permits first handle member 428 and second handle member 430 to remain aligned and engaged with each other at all times but also permits first and second handle members 428, 430 to pivot relative to each other between an open position and a closed position. When in an open position, the bases 428*b*, 430*b* of first and second handle members 428, 430 are spaced apart from each other and cannot capture front wall 316 therebetween. When in a closed position, the bases 428*b*, 430*b* interlockingly engage each other and may capture front wall 316 therebetween.

FIG. 29 illustrates a sixth embodiment of a first handle section that may be engaged with front wall 316. This sixth embodiment of the first handle section comprises a first handle member 528 and second handle member 530 that are substantially mirror images of each other. First handle member 528 includes a base 528*a*, a U-shaped flange 528*b* and the flange 528*b* and a section of base 528*a* bounds and defines a hole 528*c*. First handle member 528 also includes sides 528*d* and 528*e*. Second handle member 530 includes a base 530*a*, a U-shaped flange 530*b* and the flange 530*b* and a section of base 530*a* bound and define a hole 530*c* therein. First handle member 528 may be positioned adjacent an exterior surface 316*b* of front wall 316 and second handle member 530 may be positioned adjacent an interior surface 316*c* of front wall 316. The bases 528*a*, 530*a* are positioned so as to be aligned horizontally with each other and so that a lowermost edge of the two bases 528*a*, 530*a* are located a distance downwardly from upper end 316*a* of front wall 316 in a similar manner to how first and second handle members 328, 330 engage front wall 316. The sides 528*d*, 528*e* of first handle member 528 are aligned with the sides 530*d*, 530*e* of second handle member 530. First and second handle members 528, 530 are provided with one or more pins 536 and one or more complementary receptors 538. Pins 536 are configured to be interlock with receptors 538. Pins 536 may be inserted through holes 316*d* defined in front wall 316 or may actually be used to pierce holes 316*d* through front wall 316. Receptors 538 may take any form that is suitable to interlockingly engage and retain pin 536. So, for example, receptors 538 may comprise tubular holes that are of slightly smaller in dimension than pins 536. Pins 536 may be snap-fittingly engaged with receptors 538 to engage them together and thereby create a positive holding lock This may be accomplished by pushing first handle member 528 and second handle member 530 toward each other after they have been positioned on opposite surfaces of front wall 316 and aligned with each other.

It will be understood that some of pins 536 may be provided on first handle member 528 and some of the receptors 538 may also be provided on first handle member 530 and the complementary pins 536 and receptors 538 are located in appropriate complementary positions on the opposite first or second handle member 528, 530. Alternatively, all the pins 536 may be provided on the first handle member 528 and all the receptors 538 may be provided on the second handle member 530 or vice versa. The pins 536 and receptors 538 may be located at any suitable position along base 528*a*, 530*a* or flange 528*b*, 530*b* and are positioned to capture front wall 316*b* and hold the first handle section thereto.

Figure 30:
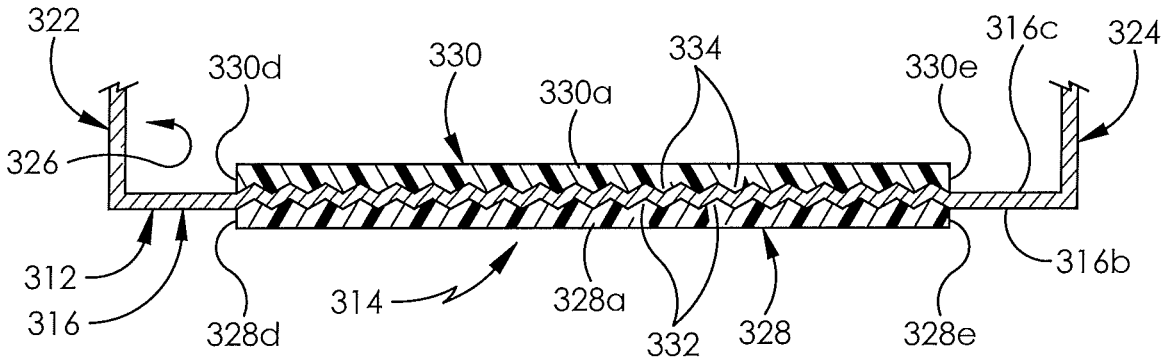
FIG. 30 is a cross-section through line 6-6 of FIG. 25 showing the first embodiment of the first handle section engaged with the front wall of the bag.
Figure 31:
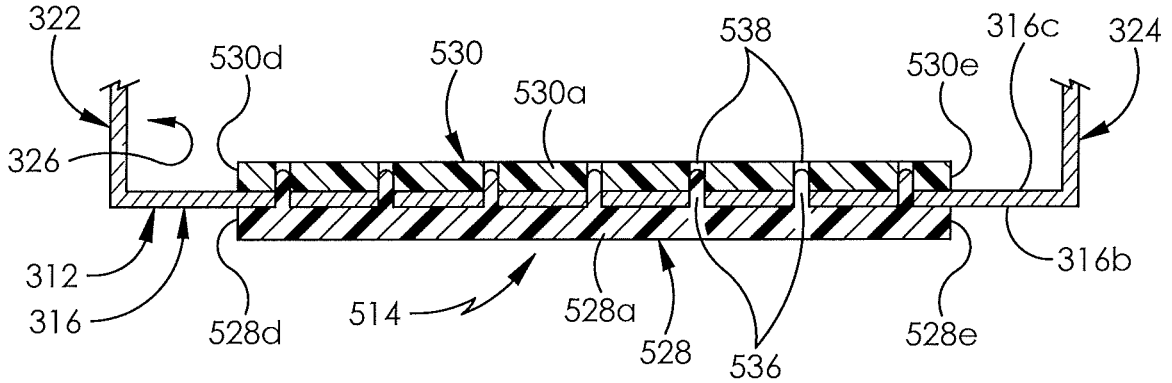
FIG. 31 is a cross-section taken along line 6-6 of FIG. 25 showing the sixth embodiment of the first handle section engaged with the front wall of the bag.

FIGS. 30 and 31 show first and second handle members 328, 330 (FIG. 30) and 528, 530 (FIG. 31) engaged with front wall 316. (First and second handle members 428, 430 may be similarly engaged with front wall 316 since they contain a combination of the teeth 432, 434 and pins 436 and receptors 438 that are similar to the teeth 332, 334 and pins 536 and receptors 538 illustrated in FIGS. 30 and 31.)

FIGS. 30 and 31 show first handle member 328, 528 positioned in abutting contact with exterior surface 316*b* of front wall 316 and second handle member 330, 530 in abutting contact with interior surface 316*a* of front wall 316. First and second handle members 328, 528, 330, 530 interlockingly engaging each other and capture a section of front wall 316 between them. FIG. 31 also shows that pins 536 and or receptors 538 extending through holes 316*d* defined in front wall 316.

It will further be understood that other mechanisms may be employed for securing first handle members 328, 428, 528 and second handle members 330, 430, 530 together. For instance a spring loaded mechanism may be employed that urges, for example, base 328*b* toward base 330*b* and clamps the section of front wall 316 therebetween. Still further, clip mechanisms may be utilized on the first and second handle members 328, 330 to hold them together. Alternatively, some type of slide lock or other locking mechanism may be utilized to retain the first handle member in engagement with the second handle member.

As indicated earlier herein, handle assembly 314 is comprised of a first handle section that is engaged with front wall 316 and a second handle section that is engaged with back wall 318. When the first and second handle sections are so engaged the U-shaped flanges (such as flanges 328*b*, 330*b*) of one of the handle sections aligns with the U-shaped flanges of the other handle section. The user will insert the fingers of their hand through the aligned apertures 328*c*, 330*c* so that they are able to grip onto handle assembly 314 and thereby hold bag 312.

If bag 312 becomes damaged, handle assembly 314 may be disengaged from bag 312 simply by separating first handle member 328 from second handle member 330. First handle member 328 and second handle member 330 may be disengaged by simply pulling their bases 328*a*, 330*a* and their U-shaped flanges 328*b*, 330*b* apart from each other. This motion will cause interlocked teeth 332, 334 or 432, 434; and/or interlocked pins 436 and receptors 438 or 536, 538 to move apart. Handle assembly 314 may then be engaged on another paper bag and bag 312 may be recycled. If handle assembly 314 becomes damaged or is no longer needed it too may be recycled.

It will be understood that handle assembly 314 may be made of materials other than plastic. Suitable materials may be wood or metal.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration set out herein are an example and the invention is not limited to the exact details shown or described.

The invention claimed is:

1. A method of securely carrying merchandise inside a bag, wherein the bag has a front wall having a top edge region; a back wall having a top edge region; and a first side and a second side that extend between the front wall and the back wall; said method comprising:

placing merchandise within an interior compartment defined by the bag;

providing a handle comprising a single planar sheet of material that includes each of a first handle section, a second handle section and a frangible zone defined between the first and second handle sections;

providing a first adhesive region on the first handle section;

folding the single planar sheet of material into a W-shaped member such that the frangible zone is located between the first handle section and the second handle section;

engaging the first handle section on the front wall of the bag adjacent the top edge region thereof by positioning the top edge region of the front wall of the bag on the first adhesive region provided on the first handle section; and adhering the top edge region of the front wall to the first adhesive region;

positioning the frangible zone of the handle across an opening defined between the top edge region of the front wall and the top edge region of the back wall;

engaging the second handle section on the back wall of the bag adjacent the top edge region thereof;

aligning an aperture defined in the first handle section with an aperture defined in the second handle section;

positioning the aligned apertures a distance vertically above the top edge region of the front wall and the top edge region of the back wall;

blocking the opening with the frangible zone; and retaining the merchandise in the interior compartment.

2. A method of securely carrying merchandise inside a bag, wherein the bag has a front wall having a top edge region; a back wall having a top edge region; and a first side and a second side that extend between the front wall and the back wall; said method comprising:

placing merchandise within an interior compartment defined by the bag;

providing a handle comprising a first handle section and a second handle section with a frangible zone defined between the first and second handle sections, wherein the first handle section, the second handle section and the frangible zone are provided on a planar sheet of material;

providing a first adhesive region on the first handle section;

positioning the top edge region of the front wall of the bag on the first adhesive region provided on the first handle section;

adhering the top edge region of the front wall to the first adhesive region to engage the first handle section on the front wall of the bag adjacent the top edge thereof;

folding the planar sheet of material over an uppermost edge of the front wall;

moving the top edge region of the front wall and the top edge region of the back wall towards each other;

positioning the frangible zone of the handle across an opening defined between the top edge region of the front wall and the top edge region of the back wall;

engaging the second handle section on the back wall of the bag adjacent the top edge region thereof;

causing the first handle section and the second handle section to extend upwardly beyond the top edge regions of the front wall and back wall;

blocking the opening with the frangible zone; and retaining the merchandise in the interior compartment.

3. The method as defined in claim 2, further comprising:

providing a second adhesive region on the second handle section;

positioning the second adhesive region on the top edge region of the back wall of the bag; and adhering the top edge region of the back wall of the bag to the second adhesive region.

4. The method as defined in claim 3, further comprising:

removing a protective liner from one or both of the first adhesive region and second adhesive region prior to adhering the one or both of the first adhesive region or the second adhesive region to the bag.

5. The method as defined in claim 3, further comprising:

aligning the first handle section with the second handle section;

grasping the first and second handle sections; and carrying the bag using the first and second handle sections.

6. The method as defined in claim 5, wherein the aligning of the first handle section and second handle section comprises:

aligning a first aperture defined in the first handle section with a second aperture defined in the second handle section.

7. The method as defined in claim 3, further comprising:

breaking the frangible zone on the planar sheet of material.

8. The method as defined in claim 7, further comprising:

moving the front wall and the back wall of the bag away from each other;

accessing the interior compartment of the bag; and removing the merchandise from the interior compartment.

9. The method as defined in claim 7, wherein the step of breaking the frangible zone includes removing a pull-tab defined by the frangible zone from the planar sheet of material.

10. The method as defined in claim 9, further comprising:

grasping a pull tab that extends outwardly beyond the first side of the bag;

moving the pull tab towards the second side of the bag; and breaking the pull tab away from the first handle section and the second handle section along a series of perforations.

11. A method of securely carrying merchandise inside a bag, wherein the bag has a front wall having a top edge region; a back wall having a top edge region; and a first side and a second side that extend between the front wall and the back wall; said method comprising:

fabricating a handle blank from a planar sheet of material, wherein the handle blank has a top surface and a bottom surface;

configuring the handle blank as a handle comprising a first handle section and a second handle section with a frangible zone defined between the first and second handle sections;

providing a first adhesive region and a second adhesive region on the top surface of the planar sheet of material on either side of the frangible zone;

providing a third adhesive region and a fourth adhesive region on the bottom surface of the planar sheet of material on either side of the frangible zone; wherein the first adhesive region and the third adhesive region are located on the first handle section and the second adhesive region and the fourth adhesive region are located on the second handle section;

placing merchandise within an interior compartment defined by the bag;

engaging the first handle section on the front wall of the bag adjacent the top edge region thereof;

positioning the frangible zone of the handle across an opening defined between the top edge region of the front wall and the top edge region of the back wall;

aligning the top edge region of the back wall of the bag with a fold line provided on the first handle section between the third adhesive region and the frangible zone;

engaging the second handle section on the back wall of the bag adjacent the top edge region thereof;

securing the top edge region of the back wall and the first handle section together using the third adhesive region;

blocking the opening with the frangible zone; and retaining the merchandise in the interior compartment.

12. The method as defined in claim 11, further comprising:

removing a protective liner from the first adhesive region;

folding a portion of the first handle section along a second fold line that is located a distance away from the first fold line, where the first fold line is positioned between the second fold line and the frangible zone; and securing the portion of the first handle section to a remaining part of the first handle section using the first adhesive region.

13. The method as defined in claim 12, further comprising:

removing a protective liner from the fourth adhesive region;

folding the second handle section about a third fold line provided between the fourth adhesive region and the frangible zone; and securing the second handle section to the top edge region of the front wall of the bag using the fourth adhesive region.

14. The method as defined in claim 13, further comprising:

removing a protective liner from the second adhesive region;

folding a portion of the second handle section about a fourth fold line provided on the second handle section; wherein the third fold line is located between the fourth fold line and the frangible zone;

aligning the portion of the second handle section with the portion of the first handle section.

15. The method as defined in claim 14, further comprising:

securing the portion of the second handle section to a remaining part of the second handle section using the second adhesive region.

16. The method as defined in claim 14, further comprising:

covering the frangible zone with the aligned and secured first and second handle sections.

17. The method as defined in claim 16, further comprising:

providing a pull tab at one or both ends of the frangible zone;

extending each pull tab beyond an associated one of the first and second sides of the bag.

18. The method as defined in claim 17, further comprising:

providing a fill line on an interior surface of the bag; and placing merchandise in the interior compartment of the bag up to a level that does not extend above the fill line.

* * * * *